US011473177B2

(12) United States Patent
Yoshida et al.

(10) Patent No.: US 11,473,177 B2
(45) Date of Patent: Oct. 18, 2022

(54) STEEL MATERIAL SUITABLE FOR USE IN SOUR ENVIRONMENT

(71) Applicant: NIPPON STEEL CORPORATION, Tokyo (JP)

(72) Inventors: Shinji Yoshida, Tokyo (JP); Yuji Arai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 179 days.

(21) Appl. No.: 16/975,318

(22) PCT Filed: Feb. 26, 2019

(86) PCT No.: PCT/JP2019/007319

§ 371 (c)(1),
(2) Date: Aug. 24, 2020

(87) PCT Pub. No.: WO2019/167945

PCT Pub. Date: Sep. 6, 2019

(65) Prior Publication Data

US 2021/0371961 A1 Dec. 2, 2021

(30) Foreign Application Priority Data

| | | |
|---|---|---|
| Feb. 28, 2018 | (JP) | JP2018-034589 |
| Feb. 28, 2018 | (JP) | JP2018-034590 |
| Feb. 28, 2018 | (JP) | JP2018-034753 |
| Feb. 28, 2018 | (JP) | JP2018-034754 |
| Feb. 28, 2018 | (JP) | JP2018-034755 |

(51) Int. Cl.

| | |
|---|---|
| ***C22C 38/14*** | (2006.01) |
| ***C22C 38/02*** | (2006.01) |
| ***C22C 38/04*** | (2006.01) |
| ***C22C 38/20*** | (2006.01) |
| ***C22C 38/32*** | (2006.01) |
| ***C22C 38/28*** | (2006.01) |
| ***C22C 38/24*** | (2006.01) |
| ***C21D 9/08*** | (2006.01) |

(52) U.S. Cl.

CPC ..... *C22C 38/14* (2013.01); *C21D 9/085* (2013.01); *C22C 38/02* (2013.01); *C22C 38/04* (2013.01); *C22C 38/20* (2013.01); *C22C 38/24* (2013.01); *C22C 38/28* (2013.01); *C22C 38/32* (2013.01)

(58) Field of Classification Search

None

See application file for complete search history.

(56) References Cited

U.S. PATENT DOCUMENTS

| | | | |
|---|---|---|---|
| 2007/0137736 | A1 | 6/2007 | Omura et al. |
| 2012/0186704 | A1 | 7/2012 | Eguchi et al. |

FOREIGN PATENT DOCUMENTS

| | | | |
|---|---|---|---|
| JP | 2000256783 | A | 9/2000 |
| JP | 2000297344 | A | 10/2000 |
| JP | 2005350754 | A | 12/2005 |
| JP | 2012026030 | A | 2/2012 |
| WO | 2010150915 | A1 | 12/2010 |

*Primary Examiner* — Anthony M Liang

(74) *Attorney, Agent, or Firm* — Greer, Burns & Crain, Ltd.

(57) ABSTRACT

The steel material according to the present disclosure has a chemical composition consisting of, in mass %, C: 0.10 to 0.60%, Si: 0.05 to 1.00%, Mn: 0.05 to 1.00%, P: 0.025% or less, S: 0.0100% or less, Al: 0.005 to 0.100%, Cr: 0.20 to 1.50%, Mo: 0.25 to 1.50%, V: 0.01 to 0.60%, Ti: 0.002 to 0.050%, B: 0.0001 to 0.0050%, N: 0.0020 to 0.0100%, and O: 0.0100% or less, with the balance being Fe and impurities. A dislocation density ρ is $3.5\times10^{15}$ $m^{-2}$ or less. Among fine precipitates, the numerical proportion of precipitates for which a ratio of the Mo content is not more than 50% is 15% or more. The yield strength is in a range of 655 to 1172 MPa.

13 Claims, No Drawings

STEEL MATERIAL SUITABLE FOR USE IN SOUR ENVIRONMENT

This is a National Phase Application filed under 35 U.S.C. § 371, of International Application No. PCT/JP2019/007319, filed Feb. 26, 2019, the contents of which are incorporated by reference.

TECHNICAL FIELD

The present invention relates to a steel material, and more particularly relates to a steel material suitable for use in a sour environment.

BACKGROUND ART

Due to the deepening of oil wells and gas wells (hereunder, oil wells and gas wells are collectively referred to as "oil wells"), there is a demand to enhance the strength of oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for 110 ksi grade (yield strength is 110 to less than 125 ksi, that is, 758 to less than 862 MPa), 125 ksi grade (yield strength is 125 to less than 140 ksi, that is, 862 to less than 965 MPa), 140 ksi grade (yield strength is 140 to less than 155 ksi, that is, 965 to less than 1069 MPa), and 155 ksi grade (yield strength is 155 to 170 ksi, that is, 1069 to 1172 MPa) oil-well steel pipes.

Most deep wells are in a sour environment containing corrosive hydrogen sulfide. In the present description, the term "sour environment" means an acidified environment containing hydrogen sulfide. Note that, in some cases a sour environment may also contain carbon dioxide. Oil-well steel pipes for use in such sour environments are required to have not only high strength, but to also have sulfide stress cracking resistance (hereunder, referred to as "SSC resistance").

Technology for enhancing the SSC resistance of steel materials as typified by oil-well steel pipes is disclosed in Japanese Patent Application Publication No. 2000-256783 (Patent Literature 1), Japanese Patent Application Publication No. 2000-297344 (Patent Literature 2), Japanese Patent Application Publication No. 2005-350754 (Patent Literature 3), Japanese Patent Application Publication No. 2012-26030 (Patent Literature 4), and International Application Publication No. WO 2010/150915 (Patent Literature 5).

A high-strength oil-well steel disclosed in Patent Literature 1 contains, in weight %, C: 0.2 to 0.35%, Cr: 0.2 to 0.7%, Mo: 0.1 to 0.5% and V: 0.1 to 0.3%. The amount of precipitating carbides is within the range of 2 to 5 weight percent, and among the precipitating carbides the proportion of MC-type carbides is within the range of 8 to 40 weight percent, and the prior-austenite grain size is No. 11 or higher in terms of the grain size numbers defined in ASTM. It is described in Patent Literature 1 that the aforementioned high-strength oil-well steel is excellent in toughness and sulfide stress corrosion cracking resistance.

A steel for oil wells that is disclosed in Patent Literature 2 is a low-alloy steel containing, in mass %, C: 0.15 to 0.3%, Cr: 0.2 to 1.5%, Mo: 0.1 to 1%, V: 0.05 to 0.3% and Nb: 0.003 to 0.1%. The amount of precipitating carbides is within the range of 1.5 to 4% by mass, the proportion that MC-type carbides occupy among the amount of carbides is within the range of 5 to 45% by mass, and when the wall thickness of the product is taken as t (mm), the proportion of $M_{23}C_6$-type carbides is (200/t) or less in percent by mass. It is described in Patent Literature 2 that the aforementioned steel for oil wells is excellent in toughness and sulfide stress corrosion cracking resistance.

A steel for low-alloy oil country tubular goods disclosed in Patent Literature 3 contains, in mass %, C: 0.20 to 0.35%, Si: 0.05 to 0.5%, Mn: 0.05 to 1.0%, P: 0.025% or less, S: 0.010% or less, Al: 0.005 to 0.10%, Cr: 0.1 to 1.0%, Mo: 0.5 to 1.0%, Ti: 0.002 to 0.05%, V: 0.05 to 0.3%, B: 0.0001 to 0.005%, N: 0.01% or less and O (oxygen): 0.01% or less. A half-value width H and a hydrogen diffusion coefficient D ($10^{-6}$ $cm^{-2}/s$) satisfy the expression ($30H+D \leq 19.5$). It is described in Patent Literature 3 that the aforementioned steel for low-alloy oil country tubular goods has excellent SSC resistance even when the steel has high strength with a yield stress (YS) of 861 MPa or more.

An oil-well steel pipe disclosed in Patent Literature 4 has a composition consisting of, in mass %, C: 0.18 to 0.25%, Si: 0.1 to 0.3%, Mn: 0.4 to 0.8%, P: 0.015% or less, S: 0.005% or less, Al: 0.01 to 0.1%, Cr: 0.3 to 0.8%, Mo: 0.5 to 1.0%, Nb: 0.003 to 0.015%, Ti: 0.002 to 0.05% and B: 0.003% or less, with the balance being Fe and unavoidable impurities. In the microstructure of the aforementioned oil-well steel pipe, a tempered martensite phase is the main phase, the number of $M_3C$ or $M_2C$ included in a region of 20 μm×20 μm and having an aspect ratio of 3 or less and a major axis of 300 nm or more when the carbide shape is taken as elliptical is not more than 10, the content of $M_{23}C_6$ is less than 1% by mass, acicular $M_2C$ precipitates inside the grains, and the amount of Nb precipitating as carbides having a size of 1 μm or more is less than 0.005% by mass. It is described in Patent Literature 4 that the aforementioned oil-well steel pipe is excellent in sulfide stress cracking resistance even when the yield strength is 862 MPa or more.

A seamless steel pipe for oil wells disclosed in Patent Literature 5 has a composition consisting of, in mass %, C: 0.15 to 0.50%, Si: 0.1 to 1.0%, Mn: 0.3 to 1.0%, P: 0.015% or less, S: 0.005% or less, Al: 0.01 to 0.1%, N: 0.01% or less, Cr: 0.1 to 1.7%, Mo: 0.4 to 1.1%, V: 0.01 to 0.12%, Nb: 0.01 to 0.08% and B: 0.0005 to 0.003%, in which the proportion of Mo that is contained as dissolved Mo is 0.40% or more, with the balance being Fe and unavoidable impurities. In the microstructure of the aforementioned seamless steel pipe for oil wells, a tempered martensite phase is the main phase, the grain size number of prior-austenite grains is 8.5 or higher, and substantially particulate $M_2C$-type precipitates are dispersed in an amount of 0.06% by mass or more. It is described in Patent Literature 5 that the aforementioned seamless steel pipe for oil wells has both a high strength of 110 ksi grade and excellent sulfide stress cracking resistance.

CITATION LIST

Patent Literature

Patent Literature 1: Japanese Patent Application Publication No. 2000-256783

Patent Literature 2: Japanese Patent Application Publication No. 2000-297344

Patent Literature 3: Japanese Patent Application Publication No. 2005-350754

Patent Literature 4: Japanese Patent Application Publication No. 2012-26030

Patent Literature 5: International Application Publication No. WO 2010/150915

SUMMARY OF INVENTION

Technical Problem

However, even if the techniques disclosed in the aforementioned Patent Literatures 1 to 5 are applied, in the case of a steel material (for example, an oil-well steel pipe) having a yield strength of 95 to 155 ksi grade (655 to 1172 MPa), excellent SSC resistance cannot be stably obtained in some cases.

An objective of the present disclosure is to provide a steel material that has a yield strength of 655 to 1172 MPa (95 to 170 ksi, 95 to 155 ksi grade) and also has excellent SSC resistance.

Solution to Problem

A steel material according to the present disclosure has a chemical composition containing, in mass %, C: 0.10 to 0.60%, Si: 0.05 to 1.00%, Mn: 0.05 to 1.00%, P: 0.025% or less, S: 0.0100% or less, Al: 0.005 to 0.100%, Cr: 0.20 to 1.50%, Mo: 0.25 to 1.50%, V: 0.01 to 0.60%, Ti: 0.002 to 0.050%, B: 0.0001 to 0.0050%, N: 0.0020 to 0.0100%, O: 0.0100% or less, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50% and rare earth metal: 0 to 0.0100%, with the balance being Fe and impurities. In the steel material, among precipitates having an equivalent circular diameter of 80 nm or less, the numerical proportion of precipitates for which a ratio of the Mo content to the total content of alloying elements excluding carbon is not more than 50% is 15% or more. The yield strength is from 655 to 1172 MPa. A dislocation density ρ is $3.5\times10^{15}$ $m^{-2}$ or less.

In a case where the yield strength is in a range from 655 to less than 758 MPa, the dislocation density ρ is less than $2.0\times10^{14}$ $m^{-2}$ and Fn1 that is expressed by Formula (1) is less than 2.90.

In a case where the yield strength is in a range from 758 to less than 862 MPa, the dislocation density ρ is not more than $3.0\times10^{14}$ $m^{-2}$ and Fn1 that is expressed by Formula (1) is 2.90 or more.

In a case where the yield strength is in a range from 862 to less than 965 MPa, the dislocation density ρ is in a range from more than $3.0\times10^{14}$ to $7.0\times10^{14}$ $m^{-2}$.

In a case where the yield strength is in a range from 965 to less than 1069 MPa, the dislocation density ρ is in a range from more than $7.0\times10^{14}$ to $15.0\times10^{14}$ $m^{-2}$.

In a case where the yield strength is in a range from 1069 to 1172 MPa, the dislocation density ρ is in a range from more than $1.5\times10^{15}$ to $3.5\times10^{15}$ $m^{-2}$.

$$Fn1=2\times10^{-7}\times\sqrt{\rho}+0.4/(1.5-1.9\times[C]) \quad (1)$$

In Formula (1), the dislocation density is substituted for ρ, and the C content in the steel material is substituted for [C].

Advantageous Effects of Invention

The steel material according to the present disclosure has a yield strength from 655 to 1172 MPa (95 to 155 ksi grade) and has excellent SSC resistance.

DESCRIPTION OF EMBODIMENTS

The present inventors conducted investigations and studies regarding a method for obtaining both a yield strength in a range from 655 to 1172 MPa (95 to 155 ksi grade) and SSC resistance in a steel material that will assumedly be used in a sour environment. As a result, the present inventors considered that if a steel material has a chemical composition consisting of, in mass %, C: 0.10 to 0.60%, Si: 0.05 to 1.00%, Mn: 0.05 to 1.00%, P: 0.025% or less, S: 0.0100% or less, Al: 0.005 to 0.100%, Cr: 0.20 to 1.50%, Mo: 0.25 to 1.50%, V: 0.01 to 0.60%, Ti: 0.002 to 0.050%, B: 0.0001 to 0.0050%, N: 0.0020 to 0.0100%, O: 0.0100% or less, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50% and rare earth metal: 0 to 0.0100%, with the balance being Fe and impurities, there is a possibility that both a yield strength in a range of 655 to 1172 MPa (95 to 155 ksi grade) and SSC resistance can be obtained.

In this case, if the dislocation density in the steel material is increased, the yield strength (YS) of the steel material will increase. However, there is a possibility that dislocations will occlude hydrogen. Therefore, if the dislocation density of the steel material increases, there is a possibility that the amount of hydrogen that the steel material occludes will also increase. If the hydrogen concentration in the steel material increases as a result of increasing the dislocation density, even if high strength is obtained, the SSC resistance of the steel material will decrease. Accordingly, in order to obtain both a yield strength in the range of 95 to 155 ksi grade and excellent SSC resistance, utilizing dislocation density to enhance the strength is not preferable.

Therefore, the present inventors first conducted studies regarding reducing the dislocation density and increasing the SSC resistance of the steel material. As a result, the present inventors discovered that if the dislocation density of the steel material is reduced to less than $2.0\times10^{14}$ ($m^{-2}$), the SSC resistance of the steel material increases.

On the other hand, as described above, if the dislocation density is increased, the yield strength of the steel material increases. That is, if the dislocation density is reduced too much, there is a possibility that the desired yield strength cannot be obtained. Therefore the present inventors first focused their attention on a yield strength in the range of 655 to less than 758 MPa (95 ksi grade), and conducted studies regarding a method that, after reducing the dislocation density to less than $2.0\times10^{14}$ ($m^{-2}$), obtains a yield strength of 95 ksi grade by a strengthening mechanism other than a strengthening mechanism that utilizes dislocation. As a result, the present inventors had the idea that by utilizing precipitation strengthening by means of alloy carbides, it may be possible to obtain a yield strength of 95 ksi grade even when the dislocation density of the steel material is reduced to less than $2.0\times10^{14}$ ($m^{-2}$).

Therefore, the present inventors conducted detailed studies regarding precipitation strengthening of the steel material by means of alloy carbides. Note that, in the present description the term "alloy carbides" means carbides of metallic elements among the alloying elements contained in the steel material.

If alloy carbides finely disperse in the steel material, the yield strength of the steel material increases. On the other hand, in some cases the alloy carbides lower the SSC resistance of the steel material. Specifically, coarse alloy carbides are liable to act as sources of stress concentration and facilitate the propagation of cracks produced by SSC. Therefore, conventionally, it has been thought that coarse alloy carbides lower the SSC resistance of steel material. That is, it has been thought that by causing fine alloy carbides to precipitate, the yield strength of a steel material can be increased while suppressing a decrease in the SSC resistance of the steel material.

However, the present inventors discovered that there are some cases where the SSC resistance decreases even if alloy carbides are finely dispersed. The present inventors considered that the reason for this is as follows. As described above, in a steel material according to the present embodiment, after the dislocation density is reduced to less than $2.0\times10^{14}$ ($m^{-2}$), a yield strength of 95 ksi grade is obtained. For this purpose, in the steel material according to the present embodiment, a large number of fine alloy carbides are caused to precipitate in the microstructure. For this reason, the present inventors considered that there is a possibility that the SSC resistance decreases because the influence of the large number of precipitated fine alloy carbides is actualized.

Therefore, the present inventors conducted investigations and studies regarding fine alloy carbides that increase the yield strength of a steel material while suppressing a decrease in the SSC resistance of the steel material. As a result, the present inventors found that, in the case of the steel material having the aforementioned chemical composition, precipitation of fine MC-type and $M_2C$-type carbides is facilitated by performing quenching and tempering. In addition, the present inventors found that within the ranges of the aforementioned chemical composition, V, Ti, and Nb easily form MC-type carbides, and Mo easily forms $M_2C$-type carbides.

Based on the above findings, the present inventors conducted further detailed studies regarding alloy carbides that can further suppress a decrease in SSC resistance.

Because MC-type carbides and $M_2C$-type carbides finely disperse and precipitate, they each can increase the yield strength of the steel material. On the other hand, comparing MC-type carbides and $M_2C$-type carbides, MC-type carbides have greater consistency with the parent phase than $M_2C$-type carbides in the microstructure of the steel material having the aforementioned chemical composition. In other words, strain at the interface with the parent phase is less in the case of MC-type carbides compared to $M_2C$-type carbides. In a case where the amount of strain in the microstructure is small, it is difficult for hydrogen to be occluded in the steel material. Therefore, if MC-type carbides are finely dispersed, occlusion and accumulation of hydrogen that is a cause of SSC can be suppressed while increasing the yield strength of the steel material.

That is, in the steel material according to the present embodiment that has the aforementioned chemical composition, among the fine alloy carbides in the microstructure, the precipitation of $M_2C$-type carbides is suppressed, and a large number of MC-type carbides are caused to precipitate. In addition, as described above, among the fine alloy carbides, Mo easily forms $M_2C$-type carbides. Therefore, among the fine alloy carbides, by increasing the proportion of alloy carbides in which the Mo content is low, the proportion of MC-type carbides precipitating in the steel material can be increased.

Therefore, in the steel material according to the present embodiment, among the fine precipitates in the steel material, the proportion of precipitates in which the ratio of the Mo content to the total content of alloying elements excluding carbon is not more than 50% is increased. In this case, the proportion of MC-type carbides in the steel material can be increased. As a result, in the steel material according to the present embodiment, the yield strength increases to a yield strength of 95 ksi grade or higher while suppressing a decrease in SSC resistance.

Thus, the steel material according to the present embodiment has the aforementioned chemical composition, the dislocation density is reduced to less than $2.0\times10^{14}$ ($m^{-2}$), and among precipitates having an equivalent circular diameter of not more than 80 nm in the steel material, the numerical proportion of precipitates for which a ratio of the Mo content to the total content of alloying elements excluding carbon is not more than 50% is 15% or more. As a result, the steel material according to the present embodiment has a yield strength of 95 ksi grade or higher can be obtained while suppressing a decrease in SSC resistance. In the present description, the term "equivalent circular diameter" means the diameter of a circle in a case where the area of a precipitate observed on a visual field surface during microstructure observation is converted into a circle having the same area.

The present inventors also conducted studies in a similar manner with respect to cases where the yield strengths are different. As described above, dislocations increase the yield strength of the steel material. Accordingly, in a case where it is intended to obtain a yield strength higher than 95 ksi grade, if the dislocation density is reduced to less than $2.0\times10^{14}$ ($m^{-2}$), the desired yield strength cannot be obtained in some cases.

Therefore, the present inventors conducted studies regarding reducing the dislocation density and increasing the SSC resistance in a case where it is intended to obtain a yield strength within a range from 758 to less than 862 MPa (110 ksi grade). As a result, the present inventors had the idea that if the dislocation density is decreased to $3.0\times10^{14}$ ($m^{-2}$) or less, there is a possibility that both a yield strength of 110 ksi grade and excellent SSC resistance can be obtained.

On the other hand, the present inventors found that, in the steel material having the aforementioned chemical composition, even if, among precipitates having an equivalent circular diameter of not more than 80 nm, the numerical proportion of precipitates for which the ratio of the Mo content to the total content of alloying elements excluding carbon is not more than 50% is 15% or more, when the dislocation density is reduced to $3.0\times10^{14}$ ($m^{-2}$) or less a yield strength of 110 ksi grade cannot be obtained in some cases.

Therefore, the present inventors studied how to increase the yield strength in a case where the dislocation density is reduced to $3.0\times10^{14}$ ($m^{-2}$) or less in the steel material having the aforementioned chemical composition, even when, among precipitates having an equivalent circular diameter of not more than 80 nm, the numerical proportion of precipitates for which the ratio of the Mo content to the total content of alloying elements excluding carbon is not more than 50% is 15% or more. As a result, the present inventors obtained the following findings.

In this case, it is defined that $Fn1=2\times10^{-7}\times\sqrt{\rho}+0.4/(1.5-1.9\times[C])$. Note that, $\rho$ in Fn1 represents the dislocation density ($m^{-2}$), and [C] represents a C content (mass %) in the steel material. Fn1 is an index of the yield strength of the steel material.

The present inventors discovered that if the dislocation density in the steel material is not more than $3.0\times10^{14}$ ($m^{-2}$) and Fn1 is 2.90 or more, on the condition that the other requirements according to the present embodiment are satisfied, a steel material having a yield strength of 110 ksi grade (758 to less than 862 MPa) is obtained.

Thus, the steel material according to the present embodiment has the aforementioned chemical composition, the dislocation density is reduced to $3.0\times10^{14}$ ($m^{-2}$) or less, the aforementioned Fn1 is made 2.90 or more, and among precipitates having an equivalent circular diameter of not more than 80 nm in the steel material, the numerical proportion of precipitates for which the ratio of the Mo content to the total content of alloying elements excluding carbon is not more than 50% is 15% or more. As a result, the steel material according to the present embodiment has a yield strength of 110 ksi grade can be obtained while suppressing a decrease in SSC resistance.

In addition, the present inventors conducted studies regarding reducing the dislocation density and increasing the SSC resistance with respect to a case where it is intended to obtain a yield strength in a range of 862 to less than 965 MPa (125 ksi grade). As a result, the present inventors discovered that if the aforementioned alloy carbides are caused to precipitate after having reduced the dislocation density to within a range of more than $3.0\times10^{14}$ to $7.0\times10^{14}$ ($m^{-2}$), a yield strength of 125 ksi grade is obtained while suppressing a decrease in SSC resistance.

That is, the steel material according to the present embodiment has the aforementioned chemical composition, the dislocation density is reduced to within a range of more than $3.0\times10^{14}$ to $7.0\times10^{14}$ ($m^{-2}$), and among precipitates having an equivalent circular diameter of not more than 80 nm in the steel material, the numerical proportion of precipitates for which the ratio of the Mo content to the total content of alloying elements excluding carbon is not more than 50% is 15% or more. As a result, the steel material according to the present embodiment has a yield strength of 125 ksi grade can be obtained while suppressing a decrease in SSC resistance.

The present inventors also conducted studies regarding reducing the dislocation density and increasing the SSC resistance with respect to a case where it is intended to obtain a yield strength in a range of 965 to less than 1069 MPa (140 ksi grade). As a result, the present inventors discovered that if the aforementioned alloy carbides are caused to precipitate after having reduced the dislocation density to within a range of more than $7.0\times10^{14}$ to $15.0\times10^{14}$ ($m^{-2}$), a yield strength of 140 ksi grade is obtained while suppressing a decrease in SSC resistance.

That is, the steel material according to the present embodiment has the aforementioned chemical composition, the dislocation density is reduced to within a range of more than $7.0\times10^{14}$ to $15.0\times10^{14}$ ($m^{-2}$), and among precipitates having an equivalent circular diameter of not more than 80 nm in the steel material, the numerical proportion of precipitates for which the ratio of the Mo content to the total content of alloying elements excluding carbon is not more than 50% is 15% or more. As a result, the steel material according to the present embodiment has a yield strength of 140 ksi grade can be obtained while suppressing a decrease in SSC resistance.

Furthermore, the present inventors conducted studies regarding reducing the dislocation density and increasing the SSC resistance with respect to a case where it is intended to obtain a yield strength in a range of 1069 to 1172 MPa (155 ksi grade). As a result, the present inventors discovered that if the aforementioned alloy carbides are caused to precipitate after having reduced the dislocation density to within a range of more than $1.5\times10^{15}$ to $3.5\times10^{15}$ ($m^{-2}$), a yield strength of 155 ksi grade is obtained while suppressing a decrease in SSC resistance.

That is, the steel material according to the present embodiment has the aforementioned chemical composition, the dislocation density is reduced to within a range of more than $1.5\times10^{15}$ to $3.5\times10^{15}$ ($m^{-2}$), and among precipitates having an equivalent circular diameter of not more than 80 nm in the steel material, the numerical proportion of precipitates for which the ratio of the Mo content to the total content of alloying elements excluding carbon is not more than 50% is 15% or more. As a result, the steel material according to the present embodiment has a yield strength of 155 ksi grade can be obtained while suppressing a decrease in SSC resistance.

Therefore, the steel material according to the present embodiment has the aforementioned chemical composition, and after having reduced the dislocation density in accordance with the yield strength (95 ksi grade, 110 ksi grade, 125 ksi grade, 140 ksi grade and 155 ksi grade) that it is intended to obtain, among precipitates having an equivalent circular diameter of not more than 80 nm in the steel material, the numerical proportion of precipitates for which the ratio of the Mo content to the total content of alloying elements excluding carbon is not more than 50% is made 15% or more. As a result, according to the steel material of the present embodiment, a desired yield strength (95 ksi grade, 110 ksi grade, 125 ksi grade, 140 ksi grade and 155 ksi grade) and excellent SSC resistance can both be obtained.

The steel material according to the present invention that was completed based on the above findings has a chemical composition consisting of, in mass %, C: 0.10 to 0.60%, Si: 0.05 to 1.00%, Mn: 0.05 to 1.00%, P: 0.025% or less, S: 0.0100% or less, Al: 0.005 to 0.100%, Cr: 0.20 to 1.50%, Mo: 0.25 to 1.50%, V: 0.01 to 0.60%, Ti: 0.002 to 0.050%, B: 0.0001 to 0.0050%, N: 0.0020 to 0.0100%, O: 0.0100% or less, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50% and rare earth metal: 0 to 0.0100%, with the balance being Fe and impurities. In the steel material, among precipitates having an equivalent circular diameter of not more than 80 nm, a numerical proportion of precipitates for which a ratio of an Mo content to a total content of alloying elements excluding carbon is not more than 50% is 15% or more. A yield strength is in a range of 655 to 1172 MPa. A dislocation density ρ is not more than $3.5\times10^{15}$ $m^{-2}$.

In a case where the yield strength is in a range from 655 to less than 758 MPa, the dislocation density ρ is less than $2.0\times10^{14}$ $m^{-1}$ and Fn1 that is expressed by Formula (1) is less than 2.90.

In a case where the yield strength is in a range from 758 to less than 862 MPa, the dislocation density ρ is not more than $3.0\times10^{14}$ $m^{-2}$ and Fn1 that is expressed by Formula (1) is 2.90 or more.

In a case where the yield strength is in a range from 862 to less than 965 MPa, the dislocation density ρ is in a range from more than $3.0\times10^{14}$ to $7.0\times10^{14}$ $m^{-2}$.

In a case where the yield strength is in a range from 965 to less than 1069

MPa, the dislocation density ρ is in a range from more than $7.0\times10^{14}$ to $15.0\times10^{14}$ $m^{-2}$.

In a case where the yield strength is in a range from 1069 to 1172 MPa, the dislocation density ρ is in a range from more than $1.5\times10^{15}$ to $3.5\times10^{15}$ $m^{-2}$.

$$Fn1=2\times10^{-7}\times\sqrt{\rho}+0.4/(1.5-1.9\times[C]) \quad (1)$$

In Formula (1), the dislocation density is substituted for ρ, and the C content in the steel material is substituted for [C].

In the present description, although not particularly limited, the steel material is, for example, a steel pipe or a steel plate.

The steel material according to the present embodiment exhibits a yield strength of 95 to 155 ksi grade and excellent SSC resistance.

The aforementioned chemical composition may contain Nb in an amount of 0.002 to 0.030%.

The aforementioned chemical composition may contain one or more types of element selected from the group consisting of Ca: 0.0001 to 0.0100%, Mg: 0.0001 to 0.0100% and Zr: 0.0001 to 0.0100%.

The aforementioned chemical composition may contain one or more types of element selected from the group consisting of Co: 0.02 to 0.50% and W: 0.02 to 0.50%.

The aforementioned chemical composition may contain one or more types of element selected from a group consisting of Ni: 0.01 to 0.50% and Cu: 0.01 to 0.50%.

The aforementioned chemical composition may contain a rare earth metal in an amount of 0.0001 to 0.0100%.

In the aforementioned steel material, a block diameter in the microstructure may be 1.5 μm or less.

In this case, the steel material according to the present embodiment exhibits even more excellent SSC resistance.

In the aforementioned steel material, the yield strength may be in a range of 655 to less than 758 MPa, the dislocation density ρ may be less than $2.0\times10^{14}$ $m^{-2}$, and Fn1 that is expressed by Formula (1) may be less than 2.90.

In the aforementioned steel material, the yield strength may be in a range of 758 to less than 862 MPa, the dislocation density ρ may be $3.0\times10^{14}$ $m^{-2}$ or less, and Fn1 that is expressed by Formula (1) may be 2.90 or more.

In the aforementioned steel material, the yield strength may be in a range of 862 to less than 965 MPa, and the dislocation density ρ may be in a range from more than $3.0\times10^{14}$ to $7.0\times10^{14}$ In the aforementioned steel material, the yield strength may be in a range of 965 to less than 1069 MPa, and the dislocation density ρ may be in a range from more than $7.0\times10^{14}$ to $15.0\times10^{14}$ In the aforementioned steel material, the yield strength may be in a range of 1069 to 1172 MPa, and the dislocation density ρ may be in a range from more than $1.5\times10^{15}$ to $3.5\times10^{15}$ $m^{-2}$.

The aforementioned steel material may be an oil-well steel pipe.

In the present description, the oil-well steel pipe may be a steel pipe that is used for a line pipe or may be a steel pipe used for oil country tubular goods. The shape of the oil-well steel pipe is not limited, and for example, the oil-well steel pipe may be a seamless steel pipe or may be a welded steel pipe. The oil country tubular goods are, for example, steel pipes that are used for use in casing or tubing.

Preferably, an oil-well steel pipe according to the present embodiment is a seamless steel pipe. If the oil-well steel pipe according to the present embodiment is a seamless steel pipe, even when the wall thickness thereof is 15 mm or more, the oil-well steel pipe has a yield strength of 655 to 1172 MPa (95 to 155 ksi grade) and has excellent SSC resistance.

Hereunder, the steel material according to the present invention is described in detail. The symbol "%" in relation to an element means "mass percent" unless specifically stated otherwise.

[Chemical Composition]

The chemical composition of the steel material according to the present embodiment contains the following elements.

C: 0.10 to 0.60%

Carbon (C) enhances the hardenability and increases the yield strength of the steel material. C also combines with metallic elements among alloying elements in the steel material to form alloy carbides. As a result, the yield strength of the steel material increases. C also promotes spheroidization of carbides during tempering in the production process. As a result, the SSC resistance of the steel material increases. In some cases C also refines a sub-microstructure of the steel material. As a result, the SSC resistance of the steel material increases further. These effects will not be obtained if the C content is too low. On the other hand, if the C content is too high, the toughness of the steel material will decrease and quench cracking is liable to occur.

Therefore, the C content is within the range of 0.10 to 0.60%. A preferable lower limit of the C content is 0.15%, and more preferably is 0.20%. A preferable lower limit of the C content in a case where it is intended to obtain a yield strength of 758 MPa or more is 0.20%, more preferably is 0.22%, and further preferably is 0.25%. A preferable upper limit of the C content is 0.58%, and more preferably is 0.55%.

Si: 0.05 to 1.00%

Silicon (Si) deoxidizes the steel. If the Si content is too low, this effect is not obtained. On the other hand, if the Si content is too high, the SSC resistance of the steel material decreases. Therefore, the Si content is within the range of 0.05 to 1.00%. A preferable lower limit of the Si content is 0.15%, and more preferably is 0.20%. A preferable upper limit of the Si content is 0.85%, and more preferably is 0.70%.

Mn: 0.05 to 1.00%

Manganese (Mn) deoxidizes the steel material. Mn also enhances the hardenability. If the Mn content is too low, these effects are not obtained. On the other hand, if the Mn content is too high, Mn segregates at grain boundaries together with impurities such as P and S. In such a case, the SSC resistance of the steel material will decrease. Therefore, the Mn content is within a range of 0.05 to 1.00%. A preferable lower limit of the Mn content is 0.25%, and more preferably is 0.30%. A preferable upper limit of the Mn content is 0.90%, and more preferably is 0.80%.

P: 0.025% or Less

Phosphorous (P) is an impurity. That is, the P content is more than 0%. P segregates at the grain boundaries and decreases the SSC resistance of the steel material. Therefore, the P content is 0.025% or less. A preferable upper limit of the P content is 0.020%, and more preferably is 0.015%. Preferably, the P content is as low as possible. However, if the P content is excessively reduced, the production cost increases significantly. Therefore, when taking industrial production into consideration, a preferable lower limit of the P content is 0.0001%, and more preferably is 0.0003%.

S: 0.0100% or Less

Sulfur (S) is an impurity. That is, the S content is more than 0%. S segregates at the grain boundaries and decreases the SSC resistance of the steel material. Therefore, the S content is 0.0100% or less. A preferable upper limit of the S content is 0.0050%, and more preferably is 0.0030%. Preferably, the S content is as low as possible. However, if the S content is excessively reduced, the production cost increases significantly. Therefore, when taking industrial production into consideration, a preferable lower limit of the S content is 0.0001%, and more preferably is 0.0003%.

Al: 0.005 to 0.100%

Aluminum (Al) deoxidizes the steel material. If the Al content is too low, this effect is not obtained and the SSC resistance of the steel material decreases. On the other hand, if the Al content is too high, coarse oxide-based inclusions are formed and the SSC resistance of the steel material decreases. Therefore, the Al content is within a range of 0.005 to 0.100%. A preferable lower limit of the Al content is 0.015%, and more preferably is 0.020%. A preferable upper limit of the Al content is 0.080%, and more preferably is 0.060%. In the present description, the "Al" content means "acid-soluble Al", that is, the content of "sol. Al".

Cr: 0.20 to 1.50%

Chromium (Cr) enhances the hardenability of the steel material. Cr also increases temper softening resistance and enables high-temperature tempering. As a result, the SSC resistance of the steel material increases. If the Cr content is too low, these effects are not obtained. On the other hand, if the Cr content is too high, the toughness and SSC resistance of the steel material decreases. Therefore, the Cr content is within a range of 0.20 to 1.50%. A preferable lower limit of the Cr content is 0.25%, more preferably is 0.35%, and further preferably is 0.40%. A preferable upper limit of the Cr content is 1.30%, and more preferably is 1.25%.

Mo: 0.25 to 1.50%

Molybdenum (Mo) enhances the hardenability of the steel material. Mo also increases temper softening resistance and enables high-temperature tempering. As a result, the SSC resistance of the steel material increases. If the Mo content is too low, these effects are not obtained. On the other hand, if the Mo content is too high, the aforementioned effects are saturated. Furthermore, if the Mo content is too high, $M_2C$-type carbides may form and the SSC resistance of the steel material will decrease. Therefore, the Mo content is within a range of 0.25 to 1.50%. A preferable lower limit of the Mo content is 0.50%, and more preferably is 0.60%. A preferable upper limit of the Mo content is 1.30%, and more preferably is 1.25%.

V: 0.01 to 0.60%

Vanadium (V) combines with carbon (C) and/or nitrogen (N) to form carbides, nitrides or carbo-nitrides (hereinafter, referred to as "carbo-nitrides and the like"). Carbo-nitrides and the like refine the substructure of the steel material by the pinning effect, and improve the SSC resistance of the steel. V also increases temper softening resistance and enables high-temperature tempering. As a result, the SSC resistance of the steel material increases. In addition, V easily combines with C to form MC-type carbides. Therefore, V suppresses the formation of $M_2C$-type carbides and enhances the SSC resistance of the steel material. If the V content is too low, these effects are not obtained. On the other hand, if the V content is too high, the toughness of the steel material decreases. Therefore, the V content is within the range of 0.01 to 0.60%. A preferable lower limit of the V content is 0.02%, more preferably is 0.04%, further preferably is 0.06%, and further preferably is 0.08%. A preferable upper limit of the V content is 0.40%, more preferably is 0.30%, and further preferably is 0.20%.

Ti: 0.002 to 0.050%

Titanium (Ti) forms nitrides, and refines crystal grains by the pinning effect. As a result, the yield strength of the steel material increases. In addition, Ti easily combines with C to form MC-type carbides. Therefore, Ti suppresses the formation of $M_2C$-type carbides and enhances the SSC resistance of the steel material. If the Ti content is too low, these effects are not obtained. On the other hand, if the Ti content is too high, Ti nitrides coarsen and the SSC resistance of the steel material decreases. Therefore, the Ti content is within a range of 0.002 to 0.050%. A preferable lower limit of the Ti content is 0.003%, and more preferably is 0.005%. A preferable upper limit of the Ti content is 0.030%, and more preferably is 0.020%.

B: 0.0001 to 0.0050%

Boron (B) dissolves in the steel, enhances the hardenability of the steel material and increases the steel material strength. If the B content is too low, this effect is not obtained. On the other hand, if the B content is too high, coarse nitrides form and the SSC resistance of the steel material decreases. Therefore, the B content is within a range of 0.0001 to 0.0050%. A preferable lower limit of the B content is 0.0003%, and more preferably is 0.0007%. A preferable upper limit of the B content is 0.0030%, more preferably is 0.0025%, and further preferably is 0.0015%.

N: 0.0020 to 0.0100%

Nitrogen (N) combines with Ti to form fine nitrides and thereby refines the grains. If the N content is too low, this effect is not obtained. On the other hand, if the N content is too high, coarse nitrides form and the SSC resistance of the steel material decreases. Therefore, the N content is within the range of 0.0020 to 0.0100%. A preferable lower limit of the N content is 0.0022%. A preferable upper limit of the N content is 0.0050%, and more preferably is 0.0045%.

O: 0.0100% or Less

Oxygen (O) is an impurity. That is, the O content is more than 0%. 0 forms coarse oxides and reduces the corrosion resistance of the steel material. Therefore, the O content is 0.0100% or less. A preferable upper limit of the O content is 0.0050%, more preferably is 0.0030%, and further preferably is 0.0020%. Preferably, the O content is as low as possible. However, if the O content is excessively reduced, the production cost increases significantly. Therefore, when taking industrial production into consideration, a preferable lower limit of the O content is 0.0001%, and more preferably is 0.0003%.

The balance of the chemical composition of the steel material according to the present embodiment is Fe and impurities. Here, the term "impurities" refers to elements which, during industrial production of the steel material, are mixed in from ore or scrap that is used as a raw material of the steel material, or from the production environment or the like, and which are allowed within a range that does not adversely affect the steel material according to the present embodiment.

[Regarding Optional Elements]

The chemical composition of the steel material described above may further contain Nb in lieu of a part of Fe.

Nb: 0 to 0.030%

Niobium (Nb) is an optional element, and need not be contained. That is, the Nb content may be 0%. If contained, Nb forms carbo-nitrides and the like. Carbo-nitrides and the like refine the substructure of the steel material by the pinning effect, and increase the SSC resistance of the steel material. In addition, Nb easily combines with C to form MC-type carbides. In addition, Nb suppresses the formation of $M_2C$-type carbides and thereby increases the SSC resistance of the steel material. If even a small amount of Nb is contained, above effects are obtained to a certain extent. However, if the Nb content is too high, nitrides and the like are excessively formed and the SSC resistance of the steel material decreases. Therefore, the Nb content is within the range of 0 to 0.030%. A preferable lower limit of the Nb content is more than 0%, more preferably is 0.002%, further preferably is 0.003%, and further preferably is 0.007%. A preferable upper limit of the Nb content is 0.025%, and more preferably is 0.020%.

The chemical composition of the steel material described above may further contain one or more types of element selected from the group consisting of Ca, Mg and Zr in lieu of a part of Fe. Each of these elements is an optional element, and increases the SSC resistance of the steel material.

Ca: 0 to 0.0100%

Calcium (Ca) is an optional element, and need not be contained. That is, the Ca content may be 0%. If contained, Ca renders S in the steel material harmless by forming sulfides, and increases the SSC resistance of the steel material. If even a small amount of Ca is contained, above effect is obtained to a certain extent. However, if the Ca content is too high, oxides in the steel material coarsen and the SSC resistance of the steel material decreases. Therefore, the Ca content is within the range of 0 to 0.0100%. A preferable lower limit of the Ca content is more than 0%, more preferably is 0.0001%, further preferably is 0.0003%, further preferably is 0.0006%, and further preferably is 0.0010%. A preferable upper limit of the Ca content is 0.0040%, more preferably is 0.0025%, and further preferably is 0.0020%.

Mg: 0 to 0.0100%

Magnesium (Mg) is an optional element, and need not be contained. That is, the Mg content may be 0%. If contained, Mg renders S in the steel material harmless by forming sulfides, and increases the SSC resistance of the steel material. If even a small amount of Mg is contained, above effect is obtained to a certain extent. However, if the Mg content is too high, oxides in the steel material coarsen and decrease the SSC resistance of the steel material. Therefore, the Mg content is within the range of 0 to 0.0100%. A preferable lower limit of the Mg content is more than 0%, more preferably is 0.0001%, further preferably is 0.0003%, further preferably is 0.0006%, and further preferably is 0.0010%. A preferable upper limit of the Mg content is 0.0040%, more preferably is 0.0025%, and further preferably is 0.0020%.

Zr: 0 to 0.0100%

Zirconium (Zr) is an optional element, and need not be contained. That is, the Zr content may be 0%. If contained, Zr renders S in the steel material harmless by forming sulfides, and increases the SSC resistance of the steel material. If even a small amount of Zr is contained, above effect is obtained to a certain extent. However, if the Zr content is too high, oxides in the steel material coarsen and the SSC resistance of the steel material decreases. Therefore, the Zr content is within the range of 0 to 0.0100%. A preferable lower limit of the Zr content is more than 0%, more preferably is 0.0001%, further preferably is 0.0003%, further preferably is 0.0006%, and further preferably is 0.0010%. A preferable upper limit of the Zr content is 0.0040%, more preferably is 0.0025%, and further preferably is 0.0020%.

In a case where two or more types of element selected from the aforementioned group consisting of Ca, Mg and Zr are contained in combination, the total amount of the content of these elements is preferably 0.0100% or less, and more preferably is 0.0050% or less.

The chemical composition of the steel material described above may further contain one or more types of element selected from the group consisting of Co and W in lieu of a part of Fe. Each of these elements is an optional element that forms a protective corrosion coating in a hydrogen sulfide environment and suppresses hydrogen penetration. By this means, each of these elements increases the SSC resistance of the steel material.

Co: 0 to 0.50%

Cobalt (Co) is an optional element, and need not be contained. That is, the Co content may be 0%. If contained, Co forms a protective corrosion coating in a hydrogen sulfide environment and suppresses hydrogen penetration. By this means, Co increases the SSC resistance of the steel material. If even a small amount of Co is contained, above effect is obtained to a certain extent. However, if the Co content is too high, the hardenability of the steel material will decrease, and the steel material strength will decrease. Therefore, the Co content is within the range of 0 to 0.50%. A preferable lower limit of the Co content is more than 0%, more preferably is 0.02%, further preferably is 0.03%, and further preferably is 0.05%. A preferable upper limit of the Co content is 0.45%, and more preferably is 0.40%.

W: 0 to 0.50%

Tungsten (W) is an optional element, and need not be contained. That is, the W content may be 0%. If contained, W forms a protective corrosion coating in a hydrogen sulfide environment and suppresses hydrogen penetration. By this means, W increases the SSC resistance of the steel material. If even a small amount of W is contained, above effect is obtained to a certain extent. However, if the W content is too high, coarse carbides form in the steel material and the SSC resistance of the steel material decreases. Therefore, the W content is within the range of 0 to 0.50%. A preferable lower limit of the W content is more than 0%, more preferably is 0.02%, further preferably is 0.03%, and further preferably is 0.05%. A preferable upper limit of the W content is 0.45%, and more preferably is 0.40%.

The chemical composition of the steel material described above may further contain one or more types of element selected from the group consisting of Ni and Cu in lieu of a part of Fe. Each of these elements is an optional element, and increases the hardenability of the steel.

Ni: 0 to 0.50%

Nickel (Ni) is an optional element, and need not be contained. That is, the Ni content may be 0%. If contained, Ni enhances the hardenability of the steel material and increases the yield strength of the steel material. If even a small amount of Ni is contained, above effect is obtained to a certain extent. However, if the Ni content is too high, the Ni will promote local corrosion, and the SSC resistance of the steel material will decrease. Therefore, the Ni content is within the range of 0 to 0.50%. A preferable lower limit of the Ni content is more than 0%, more preferably is 0.01%, and further preferably is 0.02%. A preferable upper limit of the Ni content is 0.10%, more preferably is 0.08%, and further preferably is 0.06%.

Cu: 0 to 0.50%

Copper (Cu) is an optional element, and need not be contained. That is, the Cu content may be 0%. If contained, Cu enhances the hardenability of the steel material and increases the yield strength of the steel material. If even a small amount of Cu is contained, above effect is obtained to a certain extent. However, if the Cu content is too high, the hardenability of the steel material will be too high, and the SSC resistance of the steel material will decrease. Therefore, the Cu content is within the range of 0 to 0.50%. A preferable lower limit of the Cu content is more than 0%, more preferably is 0.01%, further preferably is 0.02%, and further preferably is 0.05%. A preferable upper limit of the Cu content is 0.35%, and more preferably is 0.25%.

The chemical composition of the aforementioned steel material may also contain a rare earth metal in lieu of a part of Fe.

Rare Earth Metal (REM): 0 to 0.0100%

Rare earth metal (REM) is an optional element, and need not be contained. That is, the REM content may be 0%. If contained, REM renders S in the steel material harmless by forming sulfides, and thereby increases the SSC resistance of the steel material. REM also combines with P in the steel material and suppresses segregation of P at the crystal grain boundaries. Therefore, a decrease in the SSC resistance of the steel material that is attributable to segregation of P is suppressed. If even a small amount of REM is contained, these effects are obtained to a certain extent. However, if the REM content is too high, oxides coarsen and the low-temperature toughness and SSC resistance of the steel material decrease. Therefore, the REM content is within the range of 0 to 0.0100%. A preferable lower limit of the REM content is more than 0%, more preferably is 0.0001%, further preferably is 0.0003%, and further preferably is 0.0006%. A preferable upper limit of the REM content is 0.0040%, and more preferably is 0.0025%.

Note that, in the present description the term "REM" refers to one or more types of element selected from a group consisting of scandium which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

[Microstructure]

The microstructure of the steel material according to the present embodiment is principally composed of tempered martensite and tempered bainite. More specifically, the volume ratio of tempered martensite and/or tempered bainite in the microstructure is 90% or more. In other words, the total of the volume ratios of tempered martensite and tempered bainite in the microstructure is 90% or more. The balance of the microstructure is, for example, ferrite or pearlite. If the microstructure of the steel material having the aforementioned chemical composition contains tempered martensite and tempered bainite in an amount equivalent to a total volume ratio of 90% or more, on the condition that the other requirements according to the present embodiment are satisfied, the yield strength will be in the range of 655 to 1172 MPa (95 to 155 ksi grade).

The total volume ratio of tempered martensite and tempered bainite can also be determined by microstructure observation. In a case where the steel material is a steel plate, a test specimen having an observation surface with dimensions of 10 mm in the rolling direction and 10 mm in the plate width direction is cut out from a center portion of the thickness. In a case where the steel material is a steel pipe, a test specimen having an observation surface with dimensions of 10 mm in the pipe axis direction and 10 mm in the pipe circumferential direction is cut out from a center portion of the wall thickness. After polishing the observation surface to obtain a mirror surface, the small piece is immersed for about 10 seconds in a nital etching reagent, to reveal the microstructure by etching. The etched observation surface is observed by performing observation with respect to 10 visual fields by means of a secondary electron image obtained using a scanning electron microscope (SEM). The visual field area is 400 μm' (magnification of ×5000).

In each visual field, tempered martensite and tempered bainite can be distinguished from other phases (for example, ferrite or pearlite) based on contrast. Accordingly, tempered martensite and tempered bainite are identified in each visual field. The totals of the area fractions of the identified tempered martensite and tempered bainite are determined. In the present embodiment, the arithmetic average value of the totals of the area fractions of tempered martensite and tempered bainite determined in all of the visual fields is defined as the volume ratio of tempered martensite and tempered bainite.

[Regarding Precipitates]

In the steel material according to the present embodiment, among precipitates having an equivalent circular diameter of not more than in the steel material, 80 nm, the numerical proportion of precipitates for which the ratio of the Mo content (mass %) to the total content of alloying elements excluding carbon (mass %) is not more than 50% is 15% or more. Hereunder, precipitates having an equivalent circular diameter of not more than 80 nm are also referred to as "fine precipitates".

As described above, in the steel material according to the present embodiment, the dislocation density is reduced and the SSC resistance is increased. On the other hand, dislocations increase the yield strength of a steel material. That is, as a result of decreasing the dislocation density, in some cases the desired yield strength of a steel material cannot be obtained. Therefore, in the steel material according to the present embodiment, alloy carbides are caused to finely disperse in the microstructure.

In addition, among the fine alloy carbides, MC-type carbides have a high interfacial consistency with the parent phase. Therefore, by increasing the proportion of MC-type carbides, a decrease in SSC resistance can be suppressed even if the yield strength is increased. On the other hand, among the fine alloy carbides, Mo easily forms $M_2C$-type carbides. In addition, in the chemical composition of the steel material according to the present embodiment, almost all of the fine precipitates are alloy carbides. Therefore, among the fine precipitates, if the proportion of precipitates with a low Mo content is increased, the proportion of MC-type carbides among the fine alloy carbides can be increased.

Therefore, in the steel material according to the present embodiment, among precipitates having an equivalent circular diameter of not more than 80 nm in the steel material, the numerical proportion of precipitates in which the ratio of the Mo content to the total content of alloying elements excluding carbon is not more than 50% is 15% or more. Here, "specific precipitates" are defined as precipitates that have an equivalent circular diameter of not more than 80 nm and that are precipitates for which the ratio of the Mo content to the total content of alloying elements excluding carbon is not more than 50%.

The meaning of the statement "the numerical proportion of specific precipitates is 15% or more" in the steel material is that the numerical proportion of specific precipitates with respect to fine precipitates is 15% or more. A preferable lower limit of the numerical proportion of specific precipitates with respect to fine precipitates is 20%. The numerical proportion of specific precipitates with respect to fine precipitates may be 100%.

The numerical proportion of specific precipitates with respect to fine precipitates in the steel material according to the present embodiment can be determined by the following method. A micro test specimen for creating an extraction replica is taken from the steel material according to the present embodiment. If the steel material is a steel plate, the micro test specimen is taken from a center portion of the thickness. If the steel material is a steel pipe, the micro test specimen is taken from a center portion of the wall thickness. The surface of the micro test specimen is mirror-polished, and thereafter the micro test specimen is immersed for 10 minutes in a 3% nital etching reagent to etch the surface. The etched surface is then covered with a carbon deposited film. The micro test specimen whose surface is covered with the deposited film is immersed for 20 minutes in a 5% nital etching reagent. The deposited film is peeled off from the immersed micro test specimen. The deposited film that was peeled off from the micro test specimen is cleaned with ethanol, and thereafter is scooped up with a sheet mesh and dried.

The deposited film (replica film) is observed using a transmission electron microscope (TEM), and precipitates having an equivalent circular diameter of not more than 80 nm are identified. The observation magnification is set to ×100,000, and the acceleration voltage is set to 200 kV. Note that the precipitates can be identified based on contrast, and whether the equivalent circular diameter is not more than 80 nm can be determined by performing image analysis with respect to the observation image. Note that, in the present embodiment, although a lower limit of the equivalent circular diameter of the fine precipitates is not particularly limited, a detection limit value that is determined by the observation magnification is 10 nm. That is, precipitates having an equivalent circular diameter within a range of 10 to 80 nm are the objects of measurement in the present embodiment.

According to the aforementioned method, 30 precipitate particles (fine precipitates) having an equivalent circular diameter of not more than 80 nm are identified. The identified fine precipitates are subjected to point analysis by energy dispersive X-ray spectrometry (EDS). In the EDS point analysis, the irradiation current is set to 2.56 nA, and measurement is performed for 60 seconds at each point. Among the identified fine precipitates, the concentration of each of Mo, V, Ti, and Nb is determined in units of mass percent when taking the total of the alloying elements excluding carbon as 100%. Among the fine precipitates, the precipitates in which the Mo concentration is not more than 50% are identified as specific precipitates. The numerical proportion of the identified specific precipitates to the aforementioned 30 fine precipitate particles that were identified is defined as the numerical proportion of specific precipitates (%).

[Regarding Block Diameter]

A group of laths having almost the same orientation in the sub-microstructure of martensite is referred to as a "martensite block". A group of bainite laths having almost the same orientation in the sub-microstructure of bainite is referred to as a "bainite block". In the present description, martensite blocks and bainite blocks are together also referred to as "blocks".

In the present description, boundaries between martensite grains and between bainite grains which have an orientation difference of 15° or more in a crystal orientation map obtained by an electron backscatter diffraction pattern (EBSP) method that is described later are defined as block boundaries. In the present description, a region surrounded by a block boundary is defined as a single block.

If the blocks are fine, the strength of the martensite and bainite increases. Therefore, the yield strength of the steel material increases. Furthermore, if the blocks are fine, when performing high-temperature tempering that is described later, the dislocation density can be reduced further. The present inventors consider that the reason for this is as follows.

As described above, at a block boundary, the orientation difference between the crystal orientations is 15° or more. If blocks are fine, the strength of the steel material is increased by grain refining. In this case, the strength of the steel material can be enhanced without increasing dislocations. That is, even if the strength of the steel material is increased, a decrease in the SSC resistance of the steel material can be suppressed.

Furthermore, if the blocks are fine, it is easy for dislocations to recover during tempering. The present inventors consider that the reason for this is as follows. As described above, the orientation differences between crystal orientations at block boundaries are large. Therefore, a dislocation cannot pass through a block boundary. That is, the length of the dislocation will be shorter than the block diameter. Therefore, if blocks are fine, the length of dislocations will be short. In this case, the probability of dislocations entangling with each other decreases, and it becomes easy for dislocations to recover. Further, in a case where dislocations disappear at grain boundaries such as block boundaries, the finer the blocks are, the shorter the moved distances of the dislocations until the disappearance site will be. In this case, it is easy for dislocations to recover.

That is, if the block diameters in the steel material according to the present embodiment are 1.5 μm or less, the dislocation density of the steel material after tempering will be further reduced. Therefore, the steel material will exhibit even more excellent SSC resistance. Accordingly, block diameters in the steel material according to the present embodiment are preferably not more than 1.5 μm. Note that, although a lower limit of the block diameters in the steel material according to the present embodiment is not particularly limited, the lower limit is, for example, 0.3 μm.

In order to make the block diameters in the steel material according to the present embodiment not more than 1.5 μm, for example, it suffices to refine prior-γ grains while making the C content 0.30% or more. The reason why block diameters decrease when the C content is increased has not been clarified. However, in the chemical composition according to the present embodiment, if the C content is 0.30% or more, the block diameters of the steel material can be made 1.5 μm or less by refining the prior-γ grains.

Therefore, in the present embodiment, as one example of a method for making the block diameters 1.5 μm or less, for the steel material in which the C content is 0.30% or more, the cooling rate during quenching is made 8° C./sec or more. According to this method, coarsening of grains during quenching can be adequately suppressed, and the block diameters can be made 1.5 μm or less. However, another method may be adopted as the method for making the block diameters 1.5 μm or less.

The block diameters of the steel material according to the present embodiment can be determined by the following method. A test specimen for block diameter measurement is taken from the steel material according to the present embodiment. If the steel material is a steel plate, the test specimen is taken from a center portion of the thickness. If the steel material is a steel pipe, the test specimen is taken from a center portion of the wall thickness. The size of the test specimen is not particularly limited as long as the test specimen has an observation surface of 25 μm×25 μm centering on the center of the plate thickness or wall thickness.

EBSP measurement is performed with respect to the aforementioned observation surface in visual fields of 25 μm×25 μm at a pitch of 0.1 μm. The orientation of a body-centered cubic structure (iron) is identified based on a Kikuchi diffraction pattern obtained by means of the EBSP measurement. A crystal orientation figure is determined based on the orientation of the body-centered cubic structure (iron). From the crystal orientation figure, regions surrounded by a boundary having an orientation difference of 15° or more with adjacent crystals are distinguished to thereby obtain a crystal orientation map. A region surrounded by an orientation difference of 15° or more is defined as a single block. The equivalent circular diameters of the respective blocks are measured by employing a method for measuring the mean intercept length that is described in JIS G 0551 (2013), and are determined as the mean grain size of the respective blocks. The arithmetic average value of the equivalent circular diameters of the respective blocks within the visual field is defined as the block diameter (μm).

[Yield Strength of Steel Material]

The yield strength of the steel material according to the present embodiment is within the range of 655 to 1172 MPa (95 to 170 ksi, 95 to 155 ksi grade). As used in the present description, "yield strength" can be determined as 0.2% yield stress (hereinafter also referred to as "0.2% offset proof stress") by the offset method from stress-strain curve obtained by the tensile test.

In short, the yield strength of the steel material according to the present embodiment is within the range of 95 to 155 ksi grade. Even though the steel material according to the present embodiment has a yield strength within the range of 95 to 155 ksi grade, the steel material has excellent SSC resistance by satisfying the conditions regarding the chemical composition, dislocation density, and numerical proportion of specific precipitates with respect to fine precipitates, which are described above.

The yield strength of the steel material according to the present embodiment can be determined by the following method. A tensile test is performed in accordance with ASTM E8 (2013). A round bar test specimen is taken from the steel material according to the present embodiment. If the steel material is a steel plate, the round bar test specimen is taken from the center portion of the thickness. If the steel material is a steel pipe, the round bar test specimen is taken from the center portion of the wall thickness. Regarding the size of the round bar test specimen, for example, the round bar test specimen has a parallel portion diameter of 4 mm and a parallel portion length of 35 mm. Note that the axial direction of the round bar test specimen is parallel to the rolling direction of the steel material. A tensile test is performed in the atmosphere at normal temperature (25° C.) using the round bar test specimen, and 0.2% offset yield stress obtained in the tensile test is defined as the yield strength (MPa).

[Dislocation Density]

In the steel material according to the present embodiment, the dislocation density p is not more than $3.5\times10^{15}$ ($m^{-2}$). As described above, there is a possibility that dislocations will occlude hydrogen. Therefore, if the dislocation density is too high, the concentration of hydrogen occluded in the steel material will increase, and the SSC resistance of the steel material will decrease. On the other hand, if the dislocation density is too low, in some cases the desired yield strength cannot be obtained.

Therefore, the steel material according to the present embodiment has the aforementioned chemical composition, and in addition to reducing the dislocation density in accordance with the yield strength that it is intended to obtain, among precipitates having an equivalent circular diameter of not more than 80 nm in the steel material, the numerical proportion of precipitates for which a ratio of the Mo content to the total content of alloying elements excluding carbon is not more than 50% is made 15% or more. As a result, both the desired yield strength and excellent SSC resistance can be obtained.

[Dislocation Density when Yield Strength is 95 ksi Grade]

Specifically, in a case where the yield strength of the steel material according to the present embodiment is of 95 ksi grade (655 to less than 758 MPa), the dislocation density is less than $2.0\times10^{14}$ ($m^{-2}$) and, furthermore, Fn1 that is expressed by Formula (1) is less than 2.90:

$$Fn1=2\times10^{-7}\times\sqrt{\rho}+0.4/(1.5-1.9\times[C]) \quad (1)$$

where, ρ represents dislocation density ($m^{-2}$), and [C] represents the C content (mass %) in the steel material.

As described above, there is a possibility that dislocations will occlude hydrogen. Consequently, if the dislocation density is too high, the concentration of hydrogen occluded in the steel material will increase, and the SSC resistance of the steel material will decrease. Therefore, in a case where the yield strength is of 95 ksi grade, the dislocation density of the steel material according to the present embodiment is less than $2.0\times10^{14}$ ($m^{-2}$). Furthermore, in a case where the yield strength is of 95 ksi grade, a preferable upper limit of the dislocation density of the steel material is $1.8\times10^{14}$ ($m^{-2}$), and more preferably is $1.5\times10^{14}$ (m').

In a case where the yield strength is of 95 ksi grade, although the lower limit of the dislocation density of the steel material is not particularly limited, in some cases a yield strength of 95 ksi grade cannot be obtained if the dislocation density is reduced excessively. Therefore, in a case where the yield strength is of 95 ksi grade, a lower limit of the dislocation density of the steel material is, for example, $0.1\times10^{14}$ ($m^{-2}$).

Fn1 is an index of the yield strength of the steel material. If the dislocation density of the steel material is less than $2.0\times10^{14}$ ($m^{-2}$) and Fn1 is less than 2.90, on the condition that the other requirements according to the present embodiment are satisfied, a yield strength of 95 ksi grade (655 to less than 758 MPa) is obtained for the steel material. In contrast, if Fn1 is 2.90 or more, in some cases the yield strength will be 758 MPa or more. Therefore, in a case where the yield strength is of 95 ksi grade, Fn1 is less than 2.90. Note that, when the yield strength is of 95 ksi grade, although the lower limit of Fn1 is not particularly limited, for example, the lower limit is 0.94.

[Dislocation Density when Yield Strength is 110 ksi Grade]

When the steel material according to the present embodiment has a yield strength of 110 ksi grade (758 to less than 862 MPa), the dislocation density is not more than $3.0\times10^{14}$ ($m^{-2}$) and, in addition, Fill expressed by Formula (1) is 2.90 or more. As described above, if the dislocation density is too high, the SSC resistance of the steel material decreases. Accordingly, in a case where the yield strength is of 110 ksi grade, the dislocation density of the steel material according to the present embodiment is not more than $3.0\times10^{14}$ (re). Further, in a case where the yield strength is of 110 ksi grade, a preferable upper limit of the dislocation density of the steel material is $2.9\times10^{14}$ ($m^{-2}$), and more preferably is $2.8\times10^{14}$ ($m^{-2}$).

In a case where the yield strength is of 110 ksi grade, although the lower limit of the dislocation density of the steel material is not particularly limited, in some cases a yield strength of 110 ksi grade cannot be obtained if the dislocation density is reduced excessively. Therefore, in a case where the yield strength is of 110 ksi grade, a lower limit of the dislocation density of the steel material is, for example, $0.8\times10^{14}$ ($m^{-2}$).

As described above, Fn1 is an index of the yield strength of the steel material. If the dislocation density of the steel material is not more than $3.0\times10^{14}$ ($m^{-2}$) and Fn1 is 2.90 or more, on the condition that the other requirements according to the present embodiment are satisfied, a yield strength of 110 ksi grade (758 to less than 862 MPa) is obtained for the steel material. In contrast, if Fn1 is less than 2.90, in some cases the yield strength will be less than 758 MPa. Therefore, in a case where the yield strength is of 110 ksi grade, Fill is 2.90 or more. Note that, when the yield strength is of 110 ksi grade, although the upper limit of Fn1 is not particularly limited, for example, the upper limit is 4.58.

[Dislocation Density when Yield Strength is 125 ksi Grade]

When the steel material according to the present embodiment has a yield strength of 125 ksi grade (862 to less than 965 MPa), the dislocation density is in the range of more than $3.0\times10^{14}$ to $7.0\times10^{14}$ ($m^{-2}$). As described above, if the dislocation density is too high, the SSC resistance of the steel material decreases. On the other hand, if the dislocation density is too low, in some cases a yield strength of 125 ksi grade cannot be obtained. Therefore, in a case where the yield strength is of 125 ksi grade, the dislocation density of the steel material according to the present embodiment is in the range of more than $3.0\times10^{14}$ to $7.0\times10^{14}$ ($m^{-2}$).

In addition, when the yield strength is of 125 ksi grade, a preferable upper limit of the dislocation density of the steel material is $6.5\times10^{14}$ ($m^{-2}$), and more preferably is $6.3\times10^{14}$ ($m^{-2}$). Furthermore, when the yield strength is of 125 ksi grade, a preferable lower limit of the dislocation density of the steel material is $3.3\times10^{14}$ ($m^{-2}$), and more preferably is $3.5\times10^{14}$ ($m^{-2}$).

[Dislocation Density when Yield Strength is 140 ksi Grade]

When the steel material according to the present embodiment has a yield strength of 140 ksi grade (965 to less than 1069 MPa), the dislocation density is in the range of more than $7.0\times10^{14}$ to $15.0\times10^{14}$ ($m^{-2}$). As described above, if the dislocation density is too high, the SSC resistance of the steel material decreases. On the other hand, if the dislocation density is too low, in some cases a yield strength of 140 ksi grade cannot be obtained. Therefore, in a case where the yield strength is of 140 ksi grade, the dislocation density of the steel material according to the present embodiment is in the range of more than $7.0\times10^{14}$ to $15.0\times10^{14}$ ($m^{-2}$).

In addition, when the yield strength is of 140 ksi grade, a preferable upper limit of the dislocation density of the steel material is $14.5\times10^{14}$ ($m^{-2}$) and more preferably is $14.0\times10^{14}$ ($m^{2}$). Furthermore, when the yield strength is of 140 ksi grade, a preferable lower limit of the dislocation density of the steel material is $7.1\times10^{14}$ ($m^{-2}$) and more preferably is $7.2\times10^{14}$ ($m^{-2}$).

[Dislocation Density when Yield Strength is 155 ksi Grade]

When the steel material according to the present embodiment has a yield strength of 155 ksi grade (1069 to 1172 MPa), the dislocation density is in the range of more than $1.5\times10^{15}$ to $3.5\times10^{15}$ ($m^{-2}$). As described above, if the dislocation density is too high, the SSC resistance of the steel material decreases. On the other hand, if the dislocation density is too low, in some cases a yield strength of 155 ksi grade cannot be obtained. Accordingly, in a case where the yield strength is of 155 ksi grade, the dislocation density of the steel material according to the present embodiment is in the range of more than $1.5\times10^{15}$ to $3.5\times10^{15}$ ($m^{-2}$).

In addition, when the yield strength is of 155 ksi grade, a preferable upper limit of the dislocation density of the steel material is $3.3\times10^{15}$ ($m^{-2}$), and more preferably is $3.0\times10^{15}$ ($m^{-2}$). Furthermore, in a case where the yield strength is of 155 ksi grade, a preferable lower limit of the dislocation density of the steel material is $1.6\times10^{15}$ ($m^{-2}$).

The dislocation density of the steel material according to the present embodiment can be determined by the following method. A test specimen for use for dislocation density measurement is taken from the steel material according to the present embodiment. In a case where the steel material is a steel plate, the test specimen is taken from a center portion of the thickness. In a case where the steel material is a steel pipe, the test specimen is taken from a center portion of the wall thickness. The size of the test specimen is, for example, 20 mm width×20 mm length×2 mm thickness. The thickness direction of the test specimen is the thickness direction of the steel material (plate thickness direction or wall thickness direction). In this case, the observation surface of the test specimen is a surface having a size of 20 mm in width×20 mm in length.

The observation surface of the test specimen is mirror-polished, and furthermore electropolishing is performed using a 10 vol % perchloric acid (acetic acid solvent) solution to remove strain in the outer layer. The observation surface after the treatment is subjected to X-ray diffraction (XRD) to determine the half-value width ΔK of the peaks of the (110), (211) and (220) planes of the body-centered cubic structure (iron).

In the XRD, measurement of the half-value width ΔK is performed by employing CoKα rays as the radiation source, 30 kV as the tube voltage, and 100 mA as the tube current. In addition, $LaB_6$ (lanthanum hexaboride) powder is used in order to measure a half-value width originating from the X-ray diffractometer.

The heterogeneous strain s of the test specimen is determined based on the half-value width ΔK determined by the aforementioned method and the Williamson-Hall equation (Formula (2)).

$$\Delta K\times\cos\theta/\lambda=0.9/D+2\varepsilon\times\sin\theta/\lambda \quad (2)$$

In Formula (2), θ represents the diffraction angle, λ represents the wavelength of the X-ray, and D represents the crystallite diameter.

In addition, the dislocation density ρ ($m^{-2}$) can be determined using the obtained heterogeneous strain ε and Formula (3).

$$\rho=14.4\times\varepsilon^2/b^2 \quad (3)$$

In Formula (3), b represents the Burgers vector (b=0.248 (nm)) of the body-centered cubic structure (iron).

[Shape of Steel Material]

The shape of the steel material according to the present embodiment is not particularly limited. The steel material is, for example, a steel pipe or a steel plate. In a case where the steel material is an oil-well steel pipe, a preferable wall thickness is 9 to 60 mm. More preferably, the steel material according to the present embodiment is suitable for use as a heavy-wall seamless steel pipe. More specifically, even if the steel material according to the present invention is a seamless steel pipe having a thick wall with a thickness of 15 mm or more or, furthermore, 20 mm or more, a yield strength in a range of 655 to 1172 MPa (95 to 155 ksi grade) and excellent SSC resistance can both be obtained.

[SSC Resistance of Steel Material]

As described above, when the dislocation density is high, the concentration of hydrogen occluded in the steel material increases and the SSC resistance of the steel material decreases. On the other hand, dislocations increase the yield strength. Therefore, in the steel material according to the present embodiment, the dislocation density is reduced according to the respective yield strengths. That is, the lower the yield strength of the steel material is, the more the dislocation density is reduced, and therefore the more excellent the SSC resistance that is obtained. Therefore, according to the steel material of the present embodiment, excellent SSC resistance is defined for each yield strength.

[SSC Resistance when Yield Strength is 95 ksi Grade]

In a case where the yield strength of the steel material is of 95 ksi grade, the SSC resistance of the steel material can be evaluated by means of a method in accordance with "Method A" specified in NACE TM0177-2005, and a four-point bending test. Hereunder, excellent SSC resistance in a case where the yield strength of the steel material is of 95 ksi grade is described in detail.

When performing the method in accordance with "Method A" specified in NACE TM0177-2005, round bar test specimens are taken from the steel material according to the present embodiment. In a case where the steel material is a steel plate, the round bar test specimens are taken from a center portion of the thickness. In a case where the steel material is a steel pipe, the round bar test specimens are taken from a center portion of the wall thickness. The size of the round bar test specimen is, for example, 6.35 mm in diameter, with a parallel portion length of 25.4 mm. The axial direction of the round bar test specimen is parallel to the rolling direction of the steel material.

A mixed aqueous solution containing 5.0 mass % of sodium chloride and 0.5 mass % of acetic acid at 24° C. (Solution A) is employed as the test solution. A stress equivalent to 95% of the actual yield stress is applied to the round bar test specimen. The test solution at 24° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held for 720 hours at 24° C.

On the other hand, in the four-point bending test, two kinds of methods are used, that is, a method using $H_2S$ at 2 atm and a method using $H_2S$ at 5 atm. Test specimens are taken from the steel material according to the present embodiment. In a case where the steel material is a steel plate, a test specimen is taken from a center portion of the thickness. In a case where the steel material is a steel pipe, a test specimen is taken from a center portion of the wall thickness. The size of the test specimen is, for example, 2 mm in thickness, 10 mm in width and 75 mm in length. The length direction of the test specimen is parallel to the rolling direction of the steel material.

An aqueous solution containing 5.0 mass % of sodium chloride at 24° C. is employed as the test solution. In accordance with ASTM G39-99 (2011), stress is applied to the test specimens by four-point bending so that the stress applied to each test specimen becomes 95% of the actual yield stress. The test specimen to which stress has been applied is enclosed in an autoclave, together with the test jig. The test solution is poured into the autoclave in a manner so as to leave a vapor phase portion, and adopted as the test bath. After the test bath is degassed, $H_2S$ gas at 2 atm or $H_2S$ gas at 5 atm is sealed under pressure in the autoclave, and the test bath is stirred to cause the $H_2S$ gas to saturate. After sealing the autoclave, the test bath is stirred at 24° C.

If cracking is not confirmed after 720 hours elapses in any one of the aforementioned method in accordance with Method A, the four-point bending test using $H_2S$ at 2 atm, and the four-point bending test using $H_2S$ at 5 atm, it is determined that the steel material according to the present embodiment has excellent SSC resistance in a case where the yield strength is of 95 ksi grade. Note that, in the present description, the term "cracking is not confirmed" means that cracking is not confirmed in a test specimen in a case where the test specimen after the test was observed by the naked eye and by means of a projector with a magnification of ×10.

In the steel material according to the present embodiment, preferably the block diameters in the microstructure are 1.5 μm or less. In this case, the steel material according to the present embodiment has even more excellent SSC resistance. Here, in a case where the yield strength is of 95 ksi grade, the even more excellent SSC resistance is, specifically, as follows.

In a case where the yield strength is of 95 ksi grade, the even more excellent SSC resistance can be evaluated by means of a four-point bending test. The four-point bending test is performed in a similar manner to the aforementioned four-point bending test except that the gas which is sealed under pressure in an autoclave is $H_2S$ gas at 10 atm. If cracking is not confirmed after 720 hours elapses under the aforementioned conditions, it is determined that the steel material according to the present embodiment has even more excellent SSC resistance in a case where the yield strength is of 95 ksi grade.

[SSC Resistance when Yield Strength is 110 ksi Grade]

In a case where the yield strength of the steel material is of 110 ksi grade, the SSC resistance of the steel material can be evaluated by means of a method in accordance with "Method A" specified in NACE TM0177-2005, and a four-point bending test. Hereunder, excellent SSC resistance in a case where the yield strength of the steel material is of 110 ksi grade is described in detail.

The method in accordance with "Method A" specified in NACE TM0177-2005 is performed in a similar manner to the aforementioned method that is performed when the yield strength is of 95 ksi grade. On the other hand, the four-point bending test is performed in a similar manner to the aforementioned four-point bending test performed when the yield strength is of 95 ksi grade except that the gas that is sealed under pressure in the autoclave is $H_2S$ gas at 2 atm.

If cracking is not confirmed after 720 hours elapses in any one of the aforementioned method in accordance with Method A and the four-point bending test using $H_2S$ at 2 atm, it is determined that the steel material according to the present embodiment has excellent SSC resistance in a case where the yield strength is of 110 ksi grade.

As described above, if the block diameters in the microstructure are 1.5 μm or less, the steel material according to the present embodiment has even more excellent SSC resistance. Here, in a case where the yield strength is of 110 ksi grade, the even more excellent SSC resistance is, specifically, as follows.

In a case where the yield strength is of 110 ksi grade, the even more excellent SSC resistance can be evaluated by means of a four-point bending test. The four-point bending test is performed in a similar manner to the aforementioned four-point bending test for the yield strength of 110 ksi grade, except that the gas which is sealed under pressure in an autoclave is $H_2S$ gas at 5 atm. If cracking is not confirmed after 720 hours elapses under the aforementioned conditions, it is determined that the steel material according to the present embodiment has even more excellent SSC resistance in a case where the yield strength is of 110 ksi grade.

[SSC Resistance when Yield Strength is 125 ksi Grade]

In a case where the yield strength of the steel material is of 125 ksi grade, the SSC resistance of the steel material can be evaluated by means of a method in accordance with "Method A" specified in NACE TM0177-2005. Specifically, the method in accordance with Method A is performed in a similar manner to the aforementioned method in accordance with Method A that is performed when the yield strength is of 95 ksi grade. If cracking is not confirmed after 720 hours elapses in the method in accordance with Method A that is described above, it is determined that the steel material according to the present embodiment has excellent SSC resistance in a case where the yield strength is of 125 ksi grade.

As described above, if the block diameters in the microstructure are 1.5 μm or less, the steel material according to the present embodiment has even more excellent SSC resistance. Here, in a case where the yield strength is of 125 ksi grade, the even more excellent SSC resistance is, specifically, as follows.

In a case where the yield strength is of 125 ksi grade, the even more excellent SSC resistance can be evaluated by means of a four-point bending test. The four-point bending test is performed in a similar manner to the aforementioned four-point bending test for the yield strength of 110 ksi grade, except that the gas which is sealed under pressure in an autoclave is $H_2S$ gas at 2 atm. If cracking is not confirmed after 720 hours elapses under the aforementioned conditions, it is determined that the steel material according to the present embodiment has even more excellent SSC resistance in a case where the yield strength is of 125 ksi grade.

[SSC Resistance when Yield Strength is 140 ksi Grade]

In a case where the yield strength of the steel material is of 140 ksi grade, the SSC resistance of the steel material can be evaluated by means of a method in accordance with "Method A" specified in NACE TM0177-2005. Specifically, round bar test specimens are taken in a similar manner to the aforementioned method in accordance with Method A which is performed when the yield strength is of 95 ksi grade.

A mixed aqueous solution containing 5.0 mass % of sodium chloride and 0.4 mass % of sodium acetate that is adjusted to pH 3.5 using acetic acid (NACE solution B) is employed as the test solution. The temperature of the test solution is made 24° C. A stress equivalent to 95% of the actual yield stress is applied to the round bar test specimen. The test solution at 24° C. is poured into a test vessel so that the round bar test specimen to which the stress was applied is immersed therein, and this is adopted as the test bath. After the test bath is degassed, $H_2S$ gas at 0.1 atm and $CO_2$ gas at 0.9 atm are blown into the test bath and caused to saturate in the test bath. The test bath into which the $H_2S$ gas at 0.1 atm and $CO_2$ gas at 0.9 atm were blown is held at 24° C. for 720 hours.

If cracking is not confirmed after 720 hours elapses in the method in accordance with Method A that is described above, it is determined that the steel material according to the present embodiment has excellent SSC resistance in a case where the yield strength is of 140 ksi grade.

As described above, if the block diameters in the microstructure are 1.5 μm or less, the steel material according to the present embodiment has even more excellent SSC resistance. Here, in a case where the yield strength is of 140 ksi grade, the even more excellent SSC resistance is, specifically, as follows.

In a case where the yield strength is of 140 ksi grade, the even more excellent SSC resistance can be evaluated by a method in accordance with "Method A" specified in NACE TM0177-2005. The method in accordance with Method A is performed in a similar manner to the aforementioned method in accordance with Method A for the yield strength of 140 ksi grade, except that $H_2S$ gas at 0.3 atm and $CO_2$ gas at 0.7 atm are used as the gas that is blown into the test bath. If cracking is not confirmed after 720 hours elapses under the aforementioned conditions, it is determined that the steel material according to the present embodiment has even more excellent SSC resistance in a case where the yield strength is of 140 ksi grade.

[SSC Resistance when Yield Strength is 155 ksi Grade]

In a case where the yield strength of the steel material is of 155 ksi grade, the SSC resistance of the steel material can be evaluated by means of a method in accordance with "Method A" specified in NACE TM0177-2005. Specifically, the method in accordance with Method A is performed in a similar manner to the aforementioned method in accordance with Method A for 140 ksi grade, except that $H_2S$ gas at 0.01 atm and $CO_2$ gas at 0.99 atm are used as the gas that is blown into the test bath.

If cracking is not confirmed after 720 hours elapses under the aforementioned conditions, it is determined that the steel material according to the present embodiment has excellent SSC resistance in a case where the yield strength is of 155 ksi grade.

As described above, if the block diameters in the microstructure are 1.5 μm or less, the steel material according to the present embodiment has even more excellent SSC resistance. Here, in a case where the yield strength is of 155 ksi grade, the even more excellent SSC resistance is, specifically, as follows.

In a case where the yield strength is of 155 ksi grade, the even more excellent SSC resistance can be evaluated by a method in accordance with "Method A" specified in NACE TM0177-2005. The method in accordance with Method A is performed in a similar manner to the aforementioned method in accordance with Method A for the yield strength of 155 ksi grade, except that $H_2S$ gas at 0.03 atm and $CO_2$ gas at 0.97 atm are used as the gas that is blown into the test bath.

If cracking is not confirmed after 720 hours elapses under the aforementioned conditions, it is determined that the steel material according to the present embodiment has even more excellent SSC resistance in a case where the yield strength is of 155 ksi grade.

[Production Method]

A method for producing the steel material according to the present embodiment will now be described. The production method described hereunder is a method for producing a steel pipe as one example of the steel material according to the present embodiment. Note that, a method for producing the steel material according to the present embodiment is not limited to the production method described hereunder.

[Preparation Process]

In the preparation process, an intermediate steel material having the aforementioned chemical composition is prepared. The method for producing the intermediate steel material is not particularly limited as long as the intermediate steel material has the aforementioned chemical composition. As used here, the term "intermediate steel material" refers to a plate-shaped steel material in a case where the end product is a steel plate, and refers to a hollow shell in a case where the end product is a steel pipe.

The preparation process may preferably include a process in which a starting material is prepared (starting material preparation process), and a process in which the starting material is subjected to hot working to produce an intermediate steel material (hot working process). Hereunder, a case in which the preparation process includes the starting material preparation process and the hot working process is described in detail.

[Starting Material Preparation Process]

In the starting material preparation process, a starting material is produced using molten steel having the aforementioned chemical composition. Specifically, a cast piece (a slab, bloom or billet) is produced by a continuous casting process using the molten steel. An ingot may also be produced by an ingot-making process using the molten steel. As necessary, the slab, bloom or ingot may be subjected to blooming to produce a billet. The starting material (a slab, bloom or billet) is produced by the above described process.

[Hot Working Process]

In the hot working process, the starting material that was prepared is subjected to hot working to produce an intermediate steel material. In a case where the steel material is a steel pipe, the intermediate steel material corresponds to a hollow shell. First, the billet is heated in a heating furnace. Although the heating temperature is not particularly limited, for example, the heating temperature is within a range of 1100 to 1300° C. The billet that is extracted from the heating furnace is subjected to hot working to produce a hollow shell (seamless steel pipe). For example, the Mannesmann process is performed as the hot working to produce the hollow shell. In this case, a round billet is piercing-rolled using a piercing machine. When performing piercing-rolling, although the piercing ratio is not particularly limited, the piercing ratio is, for example, within a range of 1.0 to 4.0. The round billet that underwent piercing-rolling is further hot-rolled to form a hollow shell using a mandrel mill, a reducer, a sizing mill or the like. The cumulative reduction of area in the hot working process is, for example, 20 to 70%.

A hollow shell may also be produced from the billet by another hot working method. For example, in the case of a heavy-wall steel material of a short length such as a coupling, a hollow shell may be produced by forging by the Ehrhardt process or the like. A hollow shell is produced by the above process. Although not particularly limited, the wall thickness of the hollow shell is, for example, 9 to 60 mm.

The hollow shell produced by hot working may be air-cooled (as-rolled). The steel pipe produced by hot working may be subjected to direct quenching after hot rolling without being cooled to normal temperature, or may be subjected to quenching after undergoing supplementary heating (reheating) after hot rolling. However, in the case of performing direct quenching or quenching after supplementary heating, it is preferable to stop the cooling midway through the quenching process and conduct slow cooling for the purpose of suppressing quench cracking.

In a case where direct quenching is performed after hot rolling, or quenching is performed after supplementary heating after hot rolling, for the purpose of eliminating residual stress it is preferable to perform a stress relief treatment (SR treatment) at a time that is after quenching and before the heat treatment (quenching and the like) of the next process.

As described above, an intermediate steel material is prepared in the preparation process. The intermediate steel material may be produced by the aforementioned preferable process, or may be an intermediate steel material that was produced by a third party, or an intermediate steel material that was produced in another factory other than the factory in which a quenching process and a tempering process that are described later are performed, or at a different works.

[Quenching Process]

In the quenching process, the intermediate steel material (hollow shell) that was prepared is subjected to quenching. In the present description, the term "quenching" means rapidly cooling the intermediate steel material that is at a temperature not less than the $A_3$ point. A preferable quenching temperature is 800 to 1000° C. In a case where direct quenching is performed after hot working, the quenching temperature corresponds to the surface temperature of the intermediate steel material that is measured by a thermometer placed on the exit side of the apparatus that performs the final hot working. Further, in a case where quenching is performed using a supplementary heating furnace or a heat treatment furnace after hot working, the quenching temperature corresponds to the temperature of the supplementary heating furnace or the heat treatment furnace.

If the quenching temperature is too high, in some cases prior-γ grains become coarse and the SSC resistance of the steel material decreases. Therefore, a quenching temperature in the range of 800 to 1000° C. is preferable. A more preferable upper limit of the quenching temperature is 950° C.

The quenching method, for example, continuously cools the hollow shell from the quenching starting temperature, and continuously decreases the temperature of the hollow shell. The method of performing the continuous cooling treatment is not particularly limited, and a well-known method can be used. The method of performing the continuous cooling treatment is, for example, a method that cools the hollow shell by immersing the hollow shell in a water bath, or a method that cools the hollow shell in an accelerated manner by shower water cooling or mist cooling.

If the cooling rate during quenching is too slow, the microstructure does not become one that is principally composed of martensite and bainite, and the mechanical properties defined in the present embodiment cannot be obtained. Therefore, in the method for producing the steel material according to the present embodiment, the intermediate steel material (hollow shell) is rapidly cooled during quenching. Specifically, in the quenching process, the average cooling rate when the temperature of the intermediate steel material (hollow shell) is within the range of 800 to 500° C. during quenching is preferably made 5° C./sec or higher. If the average cooling rate when the temperature is within the range of 800 to 500° C. is 5° C./sec or more, the microstructure of the steel material according to the present embodiment stably becomes a microstructure that is principally composed of martensite and bainite.

A more preferable lower limit of the average cooling rate when the temperature is within the range of 800 to 500° C. is 8° C./sec, and further preferably is 10° C./sec. Note that, the average cooling rate when the temperature is within the range of 800 to 500° C. is determined based on a temperature that is measured at a region that is most slowly cooled within a cross-section of the intermediate steel material that is being quenched (for example, in the case of forcedly cooling both surfaces, the cooling rate is measured at the center portion of the thickness of the intermediate steel material).

In the quenching process according to the present embodiment, it is further preferable to control the average cooling rate when the temperature is within the range of 500 to 100° C. Specifically, in the quenching process according to the present embodiment, the average cooling rate when the temperature of the intermediate steel material (hollow shell) is within the range of 500 to 100° C. during quenching is defined as a cooling rate during quenching $CR_{500\text{-}100}$ (° C./sec). More specifically, the cooling rate during quenching $CR_{500\text{-}100}$ is determined based on a temperature that is measured at a region that is most slowly cooled within a cross-section of the intermediate steel material that is being quenched, in a similar manner to the average cooling rate when the temperature is within the range of 800 to 500° C.

In a similar manner to the average cooling rate when the temperature is within the range of 800 to 500° C., a preferable cooling rate during quenching $CR_{500-100}$ is 5° C./sec or higher. Among the steel materials that satisfy the chemical composition according to the present embodiment, with respect to a steel material in which the C content is 0.30% or more, if the cooling rate during quenching $CR_{500-100}$ is 8° C./sec or higher, in microstructure of the steel material according to the present embodiment, the block diameter can be made 1.5 μm or less.

As described above, if the block diameter is 1.5 μm or less in the microstructure of the steel material according to the present embodiment, the SSC resistance of the steel material is further enhanced. Therefore, the cooling rate during quenching $CR_{500-100}$ is more preferably 8° C./sec or higher. A further preferable lower limit of the cooling rate during quenching $CR_{500-100}$ is 10° C./sec. A preferable upper limit of the cooling rate during quenching $CR_{500-100}$ is 200° C./sec. Note that, if the C content of the steel material is more than 0.30%, quench cracking may occur in the steel material during quenching. Therefore, in a case where the C content of the steel material is more than 0.30%, it is preferable to set the upper limit of the cooling rate during quenching $CR_{500-100}$ to 15° C./sec.

Preferably, quenching is performed after performing heating of the hollow shell in the austenite zone a plurality of times. In this case, low-temperature toughness of the steel material increases because austenite grains are refined prior to quenching. Heating in the austenite zone may be repeated a plurality of times by performing quenching a plurality of times, or heating in the austenite zone may be repeated a plurality of times by performing normalizing and quenching.

Note that, in the case of performing quenching a plurality of times, with respect to a steel material that satisfies the chemical composition according to the present embodiment and in which the C content is 0.30% or more, if the cooling rate during quenching $CR_{500-100}$ in the final quenching is 8° C./sec or higher, the block diameter can be made 1.5 μm or less in the microstructure of the steel material according to the present embodiment.

[Tempering Process]

The tempering process is carried out by performing tempering after performing the aforementioned quenching. In the present description, the term "tempering" means reheating the intermediate steel material after quenching to a temperature that is not more than the $A_{c1}$ point and holding the intermediate steel material at that temperature. The tempering temperature is appropriately adjusted in accordance with the chemical composition of the steel material and the yield strength, which is to be obtained. That is, with respect to the intermediate steel material (hollow shell) having the chemical composition of the present embodiment, the tempering temperature is adjusted so as to adjust the yield strength of the steel material to within the range of 655 to 1172 MPa (95 to 155 ksi grade). Here, the tempering temperature corresponds to the temperature of the furnace when the intermediate steel material after quenching is heated and held at the relevant temperature.

As described above, normally, in the case of producing a steel material that is to be used for oil wells, in order to increase the SSC resistance, the dislocation density is reduced by making the tempering temperature a high temperature that is within the range of 600 to 730° C. However, in this case, alloy carbides finely disperse when the steel material is being held for tempering. Because the finely dispersed alloy carbides act as obstacles to the movement of dislocations, the finely dispersed alloy carbides suppress recovery of the dislocations (that is, the disappearance of the dislocations). Therefore, in the case of performing only tempering at a high temperature that is performed to reduce the dislocation density, the dislocation density cannot be adequately reduced in some cases.

Therefore, the steel material according to the present embodiment is subjected to tempering at a low temperature to thereby reduce the dislocation density to a certain extent in advance. In addition, tempering is performed at a high temperature to thereby refine alloy carbides and cause the alloy carbides to disperse and precipitate, while also reducing the dislocation density. That is, in the tempering process according to the present embodiment, tempering is performed in two stages, in the order of low-temperature tempering and high-temperature tempering.

In the case of performing tempering in two stages in the order of low-temperature tempering and high-temperature tempering, in addition to reducing the dislocation density as described above, among precipitates having an equivalent circular diameter of not more than 80 nm, the numerical proportion of precipitates (specific precipitates) for which the ratio of the Mo content to the total content of alloying elements excluding carbon is not more than 50% can be made 15% or more. The present inventors consider that the reason for this is as follows.

As described above, when tempering is performed on a steel material that is within the range of the chemical composition of the present embodiment, fine MC-type and $M_2C$-type carbides are liable to precipitate. In addition, within the range of the chemical composition of the present embodiment, V, Ti and Nb easily form MC-type carbides, and Mo easily forms $M_2C$-type carbides.

In a case where only tempering at the aforementioned high temperature (600 to 730° C.) is performed, depending on the tempering, MC-type carbides and $M_2C$-type carbides precipitate competitively. On the other hand, if tempering at a low temperature (100 to 500° C.) is performed before performing high-temperature tempering, cementite precipitates during the low-temperature tempering and almost no MC-type carbides and $M_2C$-type carbides precipitate. It is easier for Mo to concentrate in cementite in comparison to V, Ti and Nb. Therefore, Mo preferentially concentrates in the cementite that is precipitated by the low-temperature tempering.

That is, it is considered that the dissolved amount of Mo that easily forms $M_2C$-type carbides decreases in the steel material after low-temperature tempering. It is considered that, as a result, the proportion of MC-type carbides among the fine alloy carbides that precipitate as the result of high-temperature tempering can be increased.

Therefore, in the tempering process according to the present embodiment, tempering is performed in two stages, in the order of low-temperature tempering and high-temperature tempering. According to this method, while decreasing the dislocation density to $3.5\times10^{15}$ ($m^{-2}$) or less, the numerical proportion of specific precipitates to fine precipitates can be made 15% or more. Hereunder, the low-temperature tempering process and high-temperature tempering process are described in detail.

[Low-Temperature Tempering Process]

In the low-temperature tempering process, a preferable tempering temperature is within the range of 100 to 500° C. If the tempering temperature in the low-temperature tempering process is too high, alloy carbides will finely disperse while the steel material is being held at the tempering temperature during tempering, and in some cases the dislocation density cannot be adequately reduced. In such a case, the yield strength of the steel material becomes too high and/or the SSC resistance of the steel material decreases. Furthermore, if the tempering temperature in the low-temperature tempering process is too high, the numerical proportion of specific precipitates with respect to fine precipitates may decrease. In such a case, the SSC resistance of the steel material decreases.

On the other hand, if the tempering temperature during the low-temperature tempering process is too low, in some cases the dislocation density cannot be reduced while the steel material is being held at the tempering temperature during tempering. In such a case, the yield strength of the steel material becomes too high and/or the SSC resistance of the steel material decreases. Furthermore, if the tempering temperature in the low-temperature tempering process is too low, in some cases adequate precipitation of cementite is not caused by the low-temperature tempering, and consequently the amount of dissolved Mo in the steel material is not adequately reduced. In such a case, the numerical proportion of the specific precipitates with respect to the fine precipitates decreases. As a result, the SSC resistance of the steel material decreases.

Therefore, it is preferable to set the tempering temperature in the low-temperature tempering process within the range of 100 to 500° C. A more preferable lower limit of the tempering temperature in the low-temperature tempering process is 150° C. A more preferable upper limit of the tempering temperature in the low-temperature tempering process is 450° C., and further preferably is 420° C.

In the low-temperature tempering process, a preferable holding time for tempering (tempering time) is within the range of 10 to 90 minutes. If the tempering time in the low-temperature tempering process is too short, in some cases the dislocation density cannot be adequately reduced. In such a case, the yield strength of the steel material becomes too high and/or the SSC resistance of the steel material decreases. Furthermore, if the tempering time in the low-temperature tempering process is too short, in some cases adequate precipitation of cementite is not caused by the low-temperature tempering, and consequently the amount of dissolved Mo in the steel material is not adequately reduced. In such a case, the numerical proportion of the specific precipitates with respect to the fine precipitates decreases. As a result, the SSC resistance of the steel material decreases.

On the other hand, if the tempering time in the low-temperature tempering process is too long, the aforementioned effects are saturated. Therefore, in a case where the tempering time is made too long, the production cost rises significantly. Accordingly, in the present embodiment the tempering time is preferably set within the range of 10 to 90 minutes. A more preferable upper limit of the tempering time is 80 minutes, and further preferably is 70 minutes. Note that, in a case where the steel material is a steel pipe, in comparison to other shapes, temperature variations with respect to the steel pipe are liable to occur during holding for tempering. Therefore, in a case where the steel material is a steel pipe, the tempering time is preferably set within a range of 15 to 90 minutes.

[High-Temperature Tempering Process]

In the high-temperature tempering process, the conditions for tempering are appropriately controlled in accordance with the yield strength which it is intended to obtain. Specifically, in a case where it is intended to obtain a yield strength of 95 ksi grade (655 to less than 758 MPa), a preferable tempering temperature is within the range of 660 to 740° C. If the tempering temperature during the high-temperature tempering process is too high, in some cases the dislocation density is reduced too much and a yield strength of 95 ksi grade cannot be obtained. In contrast, if the tempering temperature during the high-temperature tempering process is too low, in some cases the dislocation density cannot be adequately reduced. In such a case, the yield strength of the steel material becomes too high and/or the SSC resistance of the steel material decreases.

Accordingly, in a case where it is intended to obtain a yield strength of 95 ksi grade, it is preferable to set the tempering temperature within the range of 660 to 740° C. When it is intended to obtain a yield strength of 95 ksi grade, a more preferable lower limit of the tempering temperature in the high-temperature tempering process is 670° C., and further preferably is 680° C. When it is intended to obtain a yield strength of 95 ksi grade, a more preferable upper limit of the tempering temperature in the high-temperature tempering process is 735° C.

In a case where it is intended to obtain a yield strength of 110 ksi grade (758 to less than 862 MPa), a preferable tempering temperature is within the range of 660 to 740° C. If the tempering temperature during the high-temperature tempering process is too high, in some cases the dislocation density is reduced too much and a yield strength of 110 ksi grade cannot be obtained. In contrast, if the tempering temperature during the high-temperature tempering process is too low, in some cases the dislocation density cannot be adequately reduced. In such a case, the yield strength of the steel material becomes too high and/or the SSC resistance of the steel material decreases.

Accordingly, in a case where it is intended to obtain a yield strength of 110 ksi grade, it is preferable to set the tempering temperature within the range of 660 to 740° C. When it is intended to obtain a yield strength of 110 ksi grade, a more preferable lower limit of the tempering temperature in the high-temperature tempering process is 670° C., and further preferably is 680° C. When it is intended to obtain a yield strength of 110 ksi grade, a more preferable upper limit of the tempering temperature in the high-temperature tempering process is 730° C.

In a case where it is intended to obtain a yield strength of 125 ksi grade (862 to less than 965 MPa), a preferable tempering temperature is within the range of 660 to 740° C. If the tempering temperature during the high-temperature tempering process is too high, in some cases the dislocation density is reduced too much and a yield strength of 125 ksi grade cannot be obtained. In contrast, if the tempering temperature during the high-temperature tempering process is too low, in some cases the dislocation density cannot be adequately reduced. In such a case, the yield strength of the steel material becomes too high and/or the SSC resistance of the steel material decreases.

Accordingly, in a case where it is intended to obtain a yield strength of 125 ksi grade, it is preferable to set the tempering temperature within the range of 660 to 740° C. When it is intended to obtain a yield strength of 125 ksi grade, a more preferable lower limit of the tempering temperature in the high-temperature tempering process is 670° C., and further preferably is 680° C. When it is intended to obtain a yield strength of 125 ksi grade, a more preferable upper limit of the tempering temperature in the high-temperature tempering process is 730° C., and further preferably is 720° C.

In a case where it is intended to obtain a yield strength of 140 ksi grade (965 to less than 1069 MPa), a preferable tempering temperature is within the range of 640 to 740° C. If the tempering temperature during the high-temperature tempering process is too high, in some cases the dislocation density is reduced too much and a yield strength of 140 ksi grade cannot be obtained. In contrast, if the tempering temperature during the high-temperature tempering process is too low, in some cases the dislocation density cannot be adequately reduced. In such a case, the yield strength of the steel material becomes too high and/or the SSC resistance of the steel material decreases.

Accordingly, in a case where it is intended to obtain a yield strength of 140 ksi grade, it is preferable to set the tempering temperature within the range of 640 to 740° C. When it is intended to obtain a yield strength of 140 ksi grade, a more preferable lower limit of the tempering temperature in the high-temperature tempering process is 650° C., and further preferably is 660° C. When it is intended to obtain a yield strength of 140 ksi grade, a more preferable upper limit of the tempering temperature in the high-temperature tempering process is 720° C., and further preferably is 710° C.

In a case where it is intended to obtain a yield strength of 155 ksi grade (1069 to 1172 MPa), a preferable tempering temperature is within the range of 620 to 740° C. If the tempering temperature during the high-temperature tempering process is too high, in some cases the dislocation density is reduced too much and a yield strength of 155 ksi grade cannot be obtained. In contrast, if the tempering temperature during the high-temperature tempering process is too low, in some cases the dislocation density cannot be adequately reduced. In such a case, the yield strength of the steel material becomes too high and/or the SSC resistance of the steel material decreases.

Accordingly, in a case where it is intended to obtain a yield strength of 155 ksi grade, it is preferable to set the tempering temperature within the range of 620 to 740° C. When it is intended to obtain a yield strength of 155 ksi grade, a more preferable lower limit of the tempering temperature in the high-temperature tempering process is 630° C., and further preferably is 640° C. When it is intended to obtain a yield strength of 155 ksi grade, a more preferable upper limit of the tempering temperature in the high-temperature tempering process is 720° C., and further preferably is 700° C.

Note that, in the high-temperature tempering process, a preferable tempering time (holding time) is within the range of 10 to 180 minutes, irrespective of the yield strength. If the tempering time is too short, in some cases the dislocation density cannot be adequately reduced. In such a case, the yield strength of the steel material becomes too high and/or the SSC resistance of the steel material decreases. On the other hand, if the tempering time is too long, the aforementioned effects are saturated.

Therefore, in the present embodiment, the tempering time is preferably set within the range of 10 to 180 minutes. A more preferable upper limit of the tempering time is 120 minutes, and further preferably is 90 minutes. Note that in a case where the steel material is a steel pipe, as described above, temperature variations are liable to occur. Therefore, when the steel material is a steel pipe, the tempering time is preferably set within the range of 15 to 180 minutes.

The aforementioned low-temperature tempering process and high-temperature tempering process can be performed as consecutive heat treatments. That is, after performing the aforementioned holding for tempering in the low-temperature tempering process, next, the high-temperature tempering process may be performed in a successive manner by heating the steel material. At this time, the low-temperature tempering process and the high-temperature tempering process may be performed within the same heat treatment furnace.

On the other hand, the aforementioned low-temperature tempering process and high-temperature tempering process can also be performed as non-consecutive heat treatments. That is, after performing the aforementioned holding for tempering in the low-temperature tempering process, the steel material may be temporarily cooled to a lower temperature than the aforementioned tempering temperature, and thereafter heated again to perform the high-temperature tempering process. Even in this case, the effects obtained by the low-temperature tempering process and high-temperature tempering process are not impaired, and the steel material according to the present embodiment can be produced.

The steel material according to the present embodiment can be produced by the production method that is described above. Note that a method for producing a steel pipe has been described as one example of the aforementioned production method. However, the steel material according to the present embodiment may be a steel plate or another shape. A method for producing a steel plate or a steel material of another shape also includes, for example, a preparation process, a quenching process and a tempering process, similarly to the production method described above. In addition, the aforementioned production method is one example, and the steel material according to the present embodiment may also be produced by another production method.

Hereunder, the present invention is described more specifically by way of examples.

Example 1

In Example 1, the SSC resistance of a steel material having a yield strength of 95 ksi grade (655 to less than 758 MPa) was investigated. Specifically, molten steels of a weight of 180 kg having the chemical compositions shown in Table 1 were produced.

TABLE 1

| Test Number | Chemical Composition (Unit is mass %; balance is Fe and impurities) | | | | | | | | | | | |
|---|---|---|---|---|---|---|---|---|---|---|---|---|
| | C | Si | Mn | P | S | Al | Cr | Mo | V | Ti | B | N |
| 1-1 | 0.22 | 0.23 | 0.44 | 0.011 | 0.0009 | 0.035 | 0.95 | 0.66 | 0.09 | 0.015 | 0.0014 | 0.0029 |
| 1-2 | 0.32 | 0.22 | 0.40 | 0.008 | 0.0007 | 0.051 | 1.05 | 0.73 | 0.08 | 0.009 | 0.0013 | 0.0043 |
| 1-3 | 0.36 | 0.32 | 0.37 | 0.006 | 0.0007 | 0.046 | 1.04 | 0.63 | 0.15 | 0.015 | 0.0011 | 0.0037 |
| 1-4 | 0.53 | 0.23 | 0.44 | 0.007 | 0.0008 | 0.027 | 1.04 | 0.71 | 0.10 | 0.011 | 0.0015 | 0.0033 |
| 1-5 | 0.34 | 0.26 | 0.36 | 0.010 | 0.0008 | 0.028 | 0.74 | 0.68 | 0.13 | 0.010 | 0.0014 | 0.0041 |
| 1-6 | 0.34 | 0.33 | 0.39 | 0.009 | 0.0008 | 0.046 | 0.95 | 1.02 | 0.10 | 0.013 | 0.0015 | 0.0044 |
| 1-7 | 0.40 | 0.26 | 0.35 | 0.011 | 0.0009 | 0.041 | 0.96 | 0.70 | 0.08 | 0.014 | 0.0011 | 0.0027 |
| 1-8 | 0.51 | 0.28 | 0.47 | 0.010 | 0.0009 | 0.027 | 0.98 | 0.71 | 0.14 | 0.009 | 0.0015 | 0.0026 |
| 1-9 | 0.44 | 0.25 | 0.41 | 0.006 | 0.0007 | 0.034 | 0.98 | 0.74 | 0.12 | 0.009 | 0.0011 | 0.0032 |
| 1-10 | 0.41 | 0.33 | 0.42 | 0.011 | 0.0009 | 0.030 | 0.99 | 0.65 | 0.11 | 0.012 | 0.0012 | 0.0044 |
| 1-11 | 0.38 | 0.30 | 0.38 | 0.006 | 0.0009 | 0.027 | 1.01 | 0.73 | 0.12 | 0.013 | 0.0014 | 0.0030 |
| 1-12 | 0.43 | 0.30 | 0.40 | 0.011 | 0.0006 | 0.050 | 0.99 | 0.72 | 0.09 | 0.015 | 0.0015 | 0.0031 |
| 1-13 | 0.52 | 0.31 | 0.38 | 0.006 | 0.0010 | 0.044 | 0.98 | 0.69 | 0.11 | 0.011 | 0.0012 | 0.0026 |
| 1-14 | 0.28 | 0.33 | 0.45 | 0.011 | 0.0008 | 0.055 | 1.04 | 1.01 | 0.03 | 0.020 | 0.0012 | 0.0045 |
| 1-15 | 0.41 | 0.33 | 0.37 | 0.007 | 0.0007 | 0.052 | 0.96 | 0.86 | 0.08 | 0.010 | 0.0015 | 0.0039 |
| 1-16 | 0.25 | 0.29 | 0.43 | 0.012 | 0.0009 | 0.042 | 0.64 | 0.71 | — | 0.014 | 0.0020 | 0.0039 |
| 1-17 | 0.28 | 0.23 | 1.26 | 0.011 | 0.0009 | 0.048 | 0.96 | 0.65 | 0.09 | 0.010 | 0.0015 | 0.0032 |
| 1-18 | 0.37 | 0.34 | 0.39 | 0.008 | 0.0007 | 0.047 | 0.06 | 0.78 | 0.12 | 0.011 | 0.0011 | 0.0047 |
| 1-19 | 0.33 | 0.27 | 0.43 | 0.011 | 0.0010 | 0.042 | 0.97 | 0.11 | 0.12 | 0.015 | 0.0013 | 0.0037 |
| 1-20 | 0.25 | 0.28 | 0.38 | 0.010 | 0.0006 | 0.039 | 0.87 | 0.58 | — | 0.011 | 0.0014 | 0.0041 |

| Test Number | Chemical Composition (Unit is mass %; balance is Fe and impurities) | | | | | | | | | |
|---|---|---|---|---|---|---|---|---|---|---|
| | O | Nb | Ca | Mg | Zr | Co | W | Ni | Cu | Nd |
| 1-1 | 0.0012 | — | — | — | — | — | — | — | — | — |
| 1-2 | 0.0012 | — | — | — | — | — | — | — | — | — |
| 1-3 | 0.0012 | — | — | — | — | — | — | — | — | — |
| 1-4 | 0.0016 | — | — | — | — | — | — | — | — | — |
| 1-5 | 0.0008 | 0.009 | — | — | — | — | — | — | — | — |
| 1-6 | 0.0013 | — | 0.0015 | — | — | — | — | — | — | — |
| 1-7 | 0.0006 | — | — | 0.0016 | — | — | — | — | — | — |
| 1-8 | 0.0008 | — | — | — | 0.0019 | — | — | — | — | — |
| 1-9 | 0.0009 | — | — | — | — | 0.30 | — | — | — | — |
| 1-10 | 0.0012 | — | — | — | — | — | 0.35 | — | — | — |
| 1-11 | 0.0008 | — | — | — | — | — | — | 0.04 | — | — |
| 1-12 | 0.0006 | — | — | — | — | — | — | — | 0.21 | — |
| 1-13 | 0.0018 | — | — | — | — | — | — | — | — | 0.0022 |
| 1-14 | 0.0013 | 0.030 | — | — | — | — | — | — | 0.05 | — |
| 1-15 | 0.0011 | — | — | — | — | — | — | — | — | — |
| 1-16 | 0.0015 | 0.011 | — | — | — | — | — | — | — | — |
| 1-17 | 0.0010 | — | — | — | — | — | — | — | — | — |
| 1-18 | 0.0006 | — | — | — | — | — | — | — | — | — |
| 1-19 | 0.0008 | — | — | — | — | — | — | — | — | — |
| 1-20 | 0.0010 | — | — | — | — | — | — | — | — | — |

Ingots were produced using the aforementioned molten steels. The ingots were hot rolled to produce steel plates having a thickness of 15 mm.

Steel plates of Test Numbers 1-1 to 1-20 after hot rolling were allowed to cool to bring the steel plate temperature to normal temperature (25° C.). Next, after being allowed to cool, the steel plate of each test number was subjected to quenching. Note that, a type K thermocouple of a sheath type was inserted into a center portion of the thickness of the steel plate in advance, and the quenching temperature and cooling rate during quenching were measured using the type K thermocouple.

The steel plate of Test Number 1-4 was subjected to quenching once. Specifically, after being allowed to cool as described above, the steel plate was reheated and the steel plate temperature was adjusted so as to become the quenching temperature (920° C.), and the steel plate was held for 20 minutes. Thereafter, water cooling was performed using a shower-type water cooling apparatus. The average cooling rate from 500° C. to 100° C. dining quenching of the steel plate of Test Number 1-4, that is, the cooling rate during quenching ($CR_{500-100}$) (° C./sec), is shown in Table 2. Note that, the average cooling rate from 800° C. to 500° C. during quenching of the steel plate of Test Number 1-4 was within a range of 5 to 300° C./sec.

On the other hand, the steel plates of Test Numbers 1-1 to 1-3 and Test Numbers 1-5 to 1-20 were subjected to quenching twice. Specifically, after being allowed to cool as described above, each steel plate was reheated and the steel plate temperature was adjusted so as to become the quenching temperature (920° C.), and the steel plate was held for 20 minutes. Each steel plate that had been held was immersed in a water bath to perform rapid cooling. Next, each steel plate was reheated and the steel plate temperature was adjusted so as to become 920° C. again, and the steel plate was held for 20 minutes. Thereafter, water cooling was performed using a shower-type water cooling apparatus.

The average cooling rate from 500° C. to 100° C. during the second quenching for each of the steel plates of Test Numbers 1-1 to 1-3 and Test Numbers 1-5 to 1-20, that is, the cooling rate during quenching ($CR_{500-100}$) (° C./sec), is shown in Table 2. Note that, both the first quenching and the second quenching, the average cooling rate from 800° C. to 500° C. during quenching of the steel plate of Test Numbers 1-1 to 1-3 and Test Numbers 1-5 to 1-20 were within a range of 5 to 300° C./sec.

TABLE 2

| Test Number | Cooling Rate During Quenching $CR_{500-100}$ (° C./sec) | First Tempering Temperature (° C.) | First Tempering Time (min) | Second Tempering Temperature (° C.) | Second Tempering Time (min) | YS (MPa) | Block Diameter (μm) | Specific Precipitates Proportion (%) | Dislocation Density ρ ($\times 10^{14}$ $m^{-2}$) | Fn1 | SSC Resistance 1 atm $H_2S$ | 2 atm $H_2S$ | 5 atm $H_2S$ | 10 atm $H_2S$ |
|---|---|---|---|---|---|---|---|---|---|---|---|---|---|---|
| 1-1 | 5 | 300 | 30 | 730 | 30 | 701 | 4.8 | 47 | 0.6 | 1.92 | E | E | E | NA |
| 1-2 | 10 | 300 | 30 | 730 | 60 | 732 | 1.5 | 30 | 0.9 | 2.35 | E | E | E | E |
| 1-3 | 5 | 300 | 30 | 730 | 60 | 743 | 3.6 | 67 | 1.3 | 2.77 | E | E | E | NA |
| 1-4 | 10 | 400 | 20 | 735 | 90 | 744 | 1.2 | 33 | 0.9 | 2.71 | E | E | E | E |
| 1-5 | 5 | 400 | 70 | 720 | 80 | 748 | 3.8 | 60 | 1.4 | 2.83 | E | E | E | NA |
| 1-6 | 5 | 350 | 40 | 730 | 45 | 729 | 3.7 | 27 | 1.0 | 2.47 | E | E | E | NA |
| 1-7 | 5 | 350 | 20 | 730 | 45 | 752 | 3.0 | 33 | 1.1 | 2.64 | E | E | E | NA |
| 1-8 | 5 | 200 | 70 | 735 | 70 | 754 | 1.9 | 50 | 0.9 | 2.65 | E | E | E | NA |
| 1-9 | 5 | 250 | 60 | 735 | 70 | 720 | 2.5 | 43 | 0.5 | 2.02 | E | E | E | NA |
| 1-10 | 5 | 400 | 20 | 735 | 60 | 725 | 2.8 | 50 | 0.6 | 2.10 | E | E | E | NA |
| 1-11 | 5 | 400 | 40 | 730 | 50 | 744 | 3.3 | 40 | 1.3 | 2.79 | E | E | E | NA |
| 1-12 | 10 | 300 | 40 | 730 | 70 | 755 | 1.4 | 37 | 1.0 | 2.59 | E | E | E | E |
| 1-13 | 5 | 300 | 40 | 735 | 70 | 751 | 1.8 | 47 | 0.9 | 2.68 | E | E | E | NA |
| 1-14 | 15 | 730 | 60 | — | — | 712 | 3.7 | 10 | 3.1 | 3.93 | E | NA | NA | NA |
| 1-15 | 5 | 735 | 60 | — | — | 729 | 2.8 | 10 | 3.2 | 4.13 | E | NA | NA | NA |
| 1-16 | 5 | 720 | 50 | 580 | 80 | 741 | 4.7 | 10 | 3.4 | 4.08 | E | NA | NA | NA |
| 1-17 | 5 | 300 | 30 | 730 | 45 | 720 | 4.1 | 30 | 1.1 | 2.51 | NA | NA | NA | NA |
| 1-18 | 5 | 300 | 30 | 730 | 50 | 743 | 3.5 | 37 | 1.4 | 2.87 | NA | NA | NA | NA |
| 1-19 | 5 | 300 | 30 | 730 | 50 | 729 | 4.0 | 100 | 1.4 | 2.82 | NA | NA | NA | NA |
| 1-20 | 5 | 300 | 30 | 730 | 60 | 621 | 4.2 | 7 | 0.4 | 1.66 | E | E | E | NA |

After quenching, the steel plates of Test Numbers 1-1 to 1-20 were subjected to tempering. For the tempering, a first tempering was performed, and thereafter, without cooling the steel plates, a second tempering was performed. Note that, a type K thermocouple of a sheath type was inserted into a center portion of the thickness of the steel plate in advance, and the tempering temperature was measured using the type K thermocouple. A tempering temperature (° C.) and tempering time (min) for each of the first tempering and the second tempering are shown in Table 2.

[Evaluation Tests]

A tensile test, a dislocation density measurement test, a specific precipitates numerical proportion measurement test, a block diameter measurement test and SSC resistance evaluation tests described hereunder were performed on the steel plates of Test Numbers 1-1 to 1-20 after the aforementioned tempering.

[Tensile Test]

A tensile test was performed in conformity with ASTM E8 (2013). Round bar tensile test specimens having a parallel portion diameter of 4 mm and a parallel portion length of 35 mm were prepared from the center portion of the thickness of the steel plate of each test number. The axial direction of the round bar tensile test specimens was parallel to the rolling direction of the steel plate. A tensile test was performed in the atmosphere at normal temperature (25° C.) using each round bar test specimen, and the yield strength (MPa) of the steel plate of each test number was obtained. Note that, in the present examples, 0.2% offset yield stress obtained in the tensile test was defined as the yield strength for each test number. The obtained yield strength is shown as "YS (MPa)" in Table 2.

[Dislocation Density Measurement Test]

Test specimens for use for dislocation density measurement by the aforementioned method were taken from the steel plate of each test number. In addition, the dislocation density ($m^{-2}$) was determined by the aforementioned method. Further, Fn1 was determined based on Formula (1). The determined dislocation density is shown in Table 2 as a dislocation density ρ ($\times 10^{14}$ $m^{-2}$). The determined value for Fn1 is also shown in Table 2.

[Specific Precipitates Numerical Proportion Measurement Test]

The numerical proportion of precipitates (specific precipitates) for which the ratio of the Mo content to the total content of alloying elements excluding carbon was not more than 50% among precipitates having an equivalent circular diameter of not more than 80 nm was measured and calculated for the steel plate of each test number by the aforementioned measurement method. Note that, the TEM used was JEM-2010 manufactured by JEOL Ltd., the acceleration voltage was set to 200 kV, and for the EDS point analysis the irradiation current was 2.56 nA, and measurement was performed for 60 seconds at each point. The numerical proportion of specific precipitates with respect to fine precipitates of the steel plate of each test number is shown as "specific precipitates proportion (%)" in Table 2.

[Block Diameter Measurement Test]

The block diameter (μm) was measured by the aforementioned measurement method for the steel plate of each test number. The determined block diameter (μm) is shown in Table 2.

[Tests to Evaluate SSC Resistance of Steel Material]

A test in accordance with "Method A" of NACE TM0177-2005, and a four-point bending test were conducted using the steel plate of each test number, and the SSC resistance was evaluated. Specifically, the test in accordance with "Method A" of NACE TM0177-2005 was conducted by the following method.

Round bar test specimens having a diameter of 6.35 mm, and a length of 25.4 mm at the parallel portion were taken from a center portion of the thickness of the steel plate of each test number. The round bar test specimens were taken in a manner such that the axial direction was parallel to the rolling direction of the steel plate. Tensile stress was applied in the axial direction of the round bar test specimens of each test number. At this time, the applied stress was adjusted so as to be 95% of the actual yield stress of each steel plate.

A mixed aqueous solution containing 5.0 mass % of sodium chloride and 0.5 mass % of acetic acid (NACE solution A) was used as the test solution. The test solution at 24° C. was poured into three test vessels, and these were adopted as test baths. The three round bar test specimens to which the stress was applied were immersed individually in mutually different test vessels as the test baths. After each test bath was degassed, $H_2S$ gas at 1 atm was blown into the respective test baths and caused to saturate. The test baths in which the $H_2S$ gas at 1 atm was saturated were held at 24° C. for 720 hours.

After immersion for 720 hours, the round bar test specimens of each test number were observed to determine whether or not sulfide stress cracking (SSC) had occurred. Specifically, after immersion for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other band, steel plates for which cracking was confirmed in at least one round bar test specimen were determined as being "NA" (Not Acceptable).

On the other hand, the four-point bending test was performed by the following method. Test specimens having a thickness of 2 mm, a width of 10 mm and a length of 75 mm were taken from the center portion of the thickness of the steel plate of each test number. The test specimens were taken in a manner such that the lengthwise direction was parallel to the rolling direction of the steel plate. A stress was applied by four-point bending to the test specimens of each test number in conformity with ASTM G39-99 (2011) so that the applied stress was adjusted so as to be 95% of the actual yield stress of each the steel plate. Three test specimens to which the stress was applied were enclosed in an autoclave, together with the test jig.

An aqueous solution containing 5.0 mass % of sodium chloride was used as the test solution. The test solution at 24° C. was poured into the autoclave in a manner so as to leave a vapor phase portion, and this was adopted as the test bath. After degassing the test bath, 2 atm of $H_2S$ was sealed therein under pressure, and the test bath was stirred to cause the $H_2S$ gas to saturate in the test bath. After sealing the autoclave, the test bath was stirred at 24° C. for 720 hours.

After being held for 720 hours, the test specimens of each test number were observed to determine whether or not sulfide stress cracking (SSC) had occurred. Specifically, after being held for 720 hours, the test specimens were observed with the naked eye and using a projector with a magnification of ×10. Steel plates for which cracking was not confirmed in all three of the test specimens as the result of the observation were determined as being "E" (Excellent). On the other hand, steel plates for which cracking was confirmed in at least one test specimen were determined as being "NA" (Not Acceptable).

A similar four-point bending test was also performed in which $H_2S$ gas at 5 atm was sealed under pressure in the autoclave. Similarly to the aforementioned method, steel plates for which cracking was not confirmed in all three of the test specimens as the result of the observation were determined as being "E". On the other hand, steel plates for which cracking was confirmed in at least one test specimen were determined as being "NA". In addition, a similar four-point bending test was also performed in which $H_2S$ gas at 10 atm was sealed under pressure in the autoclave. Similarly to the aforementioned method, steel plates for which cracking was not confirmed in all three of the test specimens as the result of the observation were determined as being "E". On the other hand, steel plates for which cracking was confirmed in at least one test specimen were determined as being "NA".

[Test Results]

The test results are shown in Table 2.

Referring to Table 1 and Table 2, the chemical composition of the respective steel plates of Test Numbers 1-1 to 1-13 was appropriate and the yield strength was within the range of 655 to less than 758 MPa (95 ksi grade). In addition, the specific precipitates proportion was 15% or more, the dislocation density ρ was less than $2.0\times10^{14}$ ($m^{-2}$), and Fn1 was less than 2.90. As a result, the aforementioned steel plates exhibited excellent SSC resistance in all of the SSC resistance tests using $H_2S$ at 1 atm, $H_2S$ at 2 atm, and $H_2S$ at 5 atm.

In addition, the block diameter of the steel plates of Test Numbers 1-2, 1-4 and 1-12 were 1.5 μm or less. As a result, the aforementioned steel plates also exhibited even more excellent SSC resistance, that is, excellent SSC resistance in the SSC resistance test using $H_2S$ at 10 atm.

On the other hand, tempering at a low temperature was not performed for the steel plate of Test Number 1-14. Consequently, the specific precipitates proportion was less than 15%. In addition, the dislocation density ρ was $2.0\times10^{14}$ ($m^{-2}$) or more, and Fn1 was 2.90 or more. As a result, the steel plate of Test Number 1-14 did not exhibit excellent SSC resistance in the SSC resistance tests using $H_2S$ at 2 atm and $H_2S$ at 5 atm.

Tempering at a low temperature was not performed for the steel plate of Test Number 1-15. Consequently, the specific precipitates proportion was less than 15%. In addition, the dislocation density ρ was $2.0\times10^{14}$ ($m^{-2}$) or more, and Fn1 was 2.90 or more. As a result, the steel plate of Test Number 1-15 did not exhibit excellent SSC resistance in the SSC resistance tests using $H_2S$ at 2 atm and $H_2S$ at 5 atm.

In the steel plate of Test Number 1-16, the V content was too low. In addition, tempering at a low temperature was performed after performing tempering at a high temperature. Consequently, the specific precipitates proportion was less than 15%. In addition, the dislocation density ρ was $2.0\times10^{14}$ ($m^{-2}$) or more, and Fn1 was 2.90 or more. As a result, the steel plate of Test Number 1-16 did not exhibit excellent SSC resistance in the SSC resistance tests using $H_2S$ at 2 atm and $H_2S$ at 5 atm.

In the steel plate of Test Number 1-17, the Mn content was too high. As a result, the steel plate of Test Number 1-17 did not exhibit excellent SSC resistance in any of the SSC resistance tests that used $H_2S$ at 1 atm, $H_2S$ at 2 atm and $H_2S$ at 5 atm.

In the steel plate of Test Number 1-18, the Cr content was too low. As a result, the steel plate of Test Number 1-18 did not exhibit excellent SSC resistance in any of the SSC resistance tests that used $H_2S$ at 1 atm, $H_2S$ at 2 atm and $H_2S$ at 5 atm.

In the steel plate of Test Number 1-19, the Mo content was too low. As a result, the steel plate of Test Number 1-19 did not exhibit excellent SSC resistance in any of the SSC resistance tests that used $H_2S$ at 1 atm, $H_2S$ at 2 atm and $H_2S$ at 5 atm.

In the steel plate of Test Number 1-20, the V content was too low. As a result, the specific precipitates proportion was less than 15%. In addition, the yield strength YS was less than 655 MPa, and a yield strength of 95 ksi grade was not obtained.

Example 2

In Example 2, the SSC resistance of a steel material having a yield strength of 110 ksi grade (758 to less than 862 MPa) was investigated. Specifically, molten steels of a weight of 180 kg having the chemical compositions shown in Table 3 were produced.

TABLE 3

| Test Number | Chemical Composition (Unit is mass %; balance is Fe and impurities) | | | | | | | | | | | |
|---|---|---|---|---|---|---|---|---|---|---|---|---|
| | C | Si | Mn | P | S | Al | Cr | Mo | V | Ti | B | N |
| 2-1 | 0.26 | 0.32 | 0.46 | 0.008 | 0.0009 | 0.026 | 1.02 | 0.63 | 0.13 | 0.013 | 0.0014 | 0.0033 |
| 2-2 | 0.34 | 0.22 | 0.47 | 0.009 | 0.0008 | 0.041 | 1.05 | 0.66 | 0.11 | 0.011 | 0.0014 | 0.0043 |
| 2-3 | 0.38 | 0.25 | 0.45 | 0.010 | 0.0010 | 0.047 | 0.99 | 0.67 | 0.15 | 0.011 | 0.0011 | 0.0043 |
| 2-4 | 0.47 | 0.31 | 0.44 | 0.012 | 0.0010 | 0.040 | 1.05 | 1.15 | 0.14 | 0.013 | 0.0014 | 0.0035 |
| 2-5 | 0.52 | 0.34 | 0.44 | 0.012 | 0.0006 | 0.049 | 0.52 | 0.69 | 0.15 | 0.013 | 0.0013 | 0.0047 |
| 2-6 | 0.32 | 0.33 | 0.46 | 0.006 | 0.0010 | 0.048 | 0.98 | 0.74 | 0.15 | 0.013 | 0.0011 | 0.0024 |
| 2-7 | 0.44 | 0.28 | 0.46 | 0.011 | 0.0007 | 0.029 | 1.00 | 0.68 | 0.08 | 0.013 | 0.0013 | 0.0042 |
| 2-8 | 0.38 | 0.29 | 0.42 | 0.011 | 0.0007 | 0.037 | 0.96 | 0.68 | 0.08 | 0.010 | 0.0013 | 0.0037 |
| 2-9 | 0.45 | 0.30 | 0.39 | 0.011 | 0.0007 | 0.054 | 0.96 | 0.74 | 0.14 | 0.012 | 0.0012 | 0.0042 |
| 2-10 | 0.34 | 0.22 | 0.43 | 0.007 | 0.0010 | 0.038 | 1.05 | 0.75 | 0.15 | 0.009 | 0.0011 | 0.0037 |
| 2-11 | 0.53 | 0.22 | 0.41 | 0.009 | 0.0010 | 0.045 | 0.95 | 0.67 | 0.15 | 0.009 | 0.0013 | 0.0048 |
| 2-12 | 0.52 | 0.30 | 0.35 | 0.012 | 0.0010 | 0.054 | 1.03 | 0.72 | 0.10 | 0.009 | 0.0011 | 0.0041 |
| 2-13 | 0.31 | 0.33 | 0.35 | 0.006 | 0.0010 | 0.028 | 0.96 | 0.64 | 0.15 | 0.010 | 0.0015 | 0.0029 |
| 2-14 | 0.25 | 0.28 | 0.60 | 0.012 | 0.0009 | 0.029 | 1.00 | 0.99 | 0.03 | 0.020 | 0.0015 | 0.0044 |
| 2-15 | 0.32 | 0.27 | 0.39 | 0.011 | 0.0006 | 0.050 | 1.02 | 0.82 | 0.08 | 0.010 | 0.0014 | 0.0037 |
| 2-16 | 0.25 | 0.23 | 0.45 | 0.010 | 0.0007 | 0.057 | 0.66 | 0.71 | — | 0.015 | 0.0022 | 0.0041 |
| 2-17 | 0.45 | 0.35 | 1.23 | 0.006 | 0.0008 | 0.044 | 0.99 | 0.63 | 0.13 | 0.014 | 0.0012 | 0.0031 |
| 2-18 | 0.44 | 0.26 | 0.47 | 0.010 | 0.0010 | 0.045 | 0.09 | 0.77 | 0.15 | 0.013 | 0.0014 | 0.0035 |
| 2-19 | 0.47 | 0.22 | 0.35 | 0.006 | 0.0006 | 0.033 | 1.04 | 0.11 | 0.08 | 0.009 | 0.0015 | 0.0029 |
| 2-20 | 0.28 | 0.24 | 0.43 | 0.008 | 0.0010 | 0.041 | 1.05 | 0.75 | — | 0.010 | 0.0012 | 0.0034 |

| Test Number | Chemical Composition (Unit is mass %; balance is Fe and impurities) | | | | | | | | | |
|---|---|---|---|---|---|---|---|---|---|---|
| | O | Nb | Ca | Mg | Zr | Co | W | Ni | Cu | Nd |
| 2-1 | 0.0012 | — | — | — | — | — | — | — | — | — |
| 2-2 | 0.0014 | — | — | — | — | — | — | — | — | — |
| 2-3 | 0.0006 | — | — | — | — | — | — | — | — | — |
| 2-4 | 0.0007 | — | — | — | — | — | — | — | — | — |
| 2-5 | 0.0007 | 0.011 | — | — | — | — | — | — | — | — |
| 2-6 | 0.0008 | — | 0.0023 | — | — | — | — | — | — | — |
| 2-7 | 0.0018 | — | — | 0.0019 | — | — | — | — | — | — |
| 2-8 | 0.0017 | — | — | — | 0.0017 | — | — | — | — | — |
| 2-9 | 0.0006 | — | — | — | — | 0.33 | — | — | — | — |
| 2-10 | 0.0015 | — | — | — | — | — | 0.29 | — | — | — |
| 2-11 | 0.0015 | — | — | — | — | — | — | 0.05 | — | — |
| 2-12 | 0.0010 | — | — | — | — | — | — | — | 0.23 | — |
| 2-13 | 0.0016 | — | — | — | — | — | — | — | — | 0.0024 |
| 2-14 | 0.0011 | 0.030 | — | — | — | — | — | — | 0.05 | — |
| 2-15 | 0.0007 | — | — | — | — | — | — | — | — | — |
| 2-16 | 0.0014 | 0.010 | — | — | — | — | — | — | — | — |
| 2-17 | 0.0013 | — | — | — | — | — | — | — | — | — |
| 2-18 | 0.0014 | — | — | — | — | — | — | — | — | — |
| 2-19 | 0.0013 | — | — | — | — | — | — | — | — | — |
| 2-20 | 0.0009 | — | — | — | — | — | — | — | — | — |

Steel plates having a thickness of 15 mm were produced in a similar manner to Example 1. Thereafter, quenching was performed in a similar manner to Example 1. Quenching was performed once for Test Number 2-4, and quenching was performed twice for Test Numbers 2-1 to 2-3 and Test Numbers 2-5 to 2-20. The other quenching conditions were the same as in Example 1.

The average cooling rate from 500° C. to 100° C. during quenching of the steel plate of Test Number 2-4, that is, the cooling rate during quenching ($CR_{500-100}$) (° C./sec), is shown in Table 4. The average cooling rate from 500° C. to 100° C. during the second quenching, that is, the cooling rate during quenching ($CR_{500-100}$) (° C./sec), of each of the steel plates of Test Numbers 2-1 to 2-3 and Test Numbers 2-5 to 2-20 is shown in Table 4. Here, the average cooling rate from 800° C. to 500° C. during quenching of the steel plate of Test Number 2-4 was within a range of 5 to 300° C./sec. Here, both the first quenching and the second quenching, the average cooling rate from 800° C. to 500° C. dining quenching of the steel plate of Test Numbers 2-1 to 2-3 and Test Numbers 2-5 to 2-20 were within a range of 5 to 300° C./sec.

TABLE 4

| Test Number | Cooling Rate During Quenching $CR_{500-100}$ (° C./sec) | First Tempering Temperature (° C.) | First Tempering Time (min) | Second Tempering Temperature (° C.) | Second Tempering Time (min) | YS (MPa) | Block Diameter (μm) | Specific Precipitates Proportion (%) | Dislocation Density ρ ($\times 10^{14}$ $m^{-2}$) | Fn1 | SSC Resistance 1 atm $H_2S$ | SSC Resistance 2 atm $H_2S$ | SSC Resistance 5 atm $H_2S$ |
|---|---|---|---|---|---|---|---|---|---|---|---|---|---|
| 2-1 | 5 | 300 | 30 | 720 | 45 | 760 | 4.1 | 50 | 1.6 | 2.93 | E | E | NA |
| 2-2 | 10 | 300 | 20 | 720 | 45 | 775 | 1.5 | 40 | 1.5 | 2.92 | E | E | E |

TABLE 4-continued

| Test Number | Cooling Rate During Quenching $CR_{500-100}$ (° C./sec) | First Tempering Tempering Temperature (° C.) | First Tempering Tempering Time (min) | Second Tempering Tempering Temperature (° C.) | Second Tempering Tempering Time (min) | YS (MPa) | Block Diameter (μm) | Specific Precipitates Proportion (%) | Dislocation Density ρ ($\times 10^{14}$ $m^{-2}$) | Fn1 | SSC Resistance 1 atm $H_2S$ | SSC Resistance 2 atm $H_2S$ | SSC Resistance 5 atm $H_2S$ |
|---|---|---|---|---|---|---|---|---|---|---|---|---|---|
| 2-3 | 5 | 300 | 30 | 720 | 45 | 797 | 3.4 | 50 | 1.9 | 3.27 | E | E | NA |
| 2-4 | 5 | 300 | 30 | 720 | 45 | 835 | 2.3 | 23 | 2.0 | 3.49 | E | E | NA |
| 2-5 | 10 | 350 | 20 | 720 | 80 | 804 | 1.3 | 57 | 1.2 | 2.97 | E | E | E |
| 2-6 | 5 | 350 | 30 | 710 | 30 | 809 | 3.6 | 43 | 2.1 | 3.35 | E | E | NA |
| 2-7 | 5 | 350 | 20 | 720 | 30 | 810 | 2.6 | 30 | 1.6 | 3.13 | E | E | NA |
| 2-8 | 5 | 200 | 60 | 720 | 60 | 789 | 3.3 | 27 | 1.8 | 3.20 | E | E | NA |
| 2-9 | 5 | 250 | 60 | 720 | 60 | 801 | 2.5 | 43 | 1.4 | 2.99 | E | E | NA |
| 2-10 | 5 | 400 | 20 | 710 | 60 | 806 | 3.5 | 40 | 2.0 | 3.30 | E | E | NA |
| 2-11 | 5 | 400 | 20 | 730 | 45 | 761 | 2.7 | 57 | 1.1 | 2.91 | E | E | NA |
| 2-12 | 10 | 300 | 40 | 720 | 70 | 811 | 1.4 | 30 | 1.2 | 2.97 | E | E | E |
| 2-13 | 5 | 300 | 40 | 700 | 30 | 855 | 3.6 | 47 | 2.7 | 3.73 | E | E | NA |
| 2-14 | 15 | 720 | 40 | — | — | 772 | 4.2 | 7 | 4.5 | 4.73 | E | NA | NA |
| 2-15 | 5 | 720 | 60 | — | — | 764 | 3.5 | 10 | 4.0 | 4.45 | NA | NA | NA |
| 2-16 | 5 | 710 | 45 | 580 | 70 | 789 | 4.7 | 7 | 3.8 | 4.29 | NA | NA | NA |
| 2-17 | 5 | 300 | 30 | 720 | 45 | 831 | 2.6 | 47 | 1.9 | 3.38 | NA | NA | NA |
| 2-18 | 5 | 300 | 30 | 720 | 50 | 827 | 2.7 | 50 | 1.8 | 3.29 | NA | NA | NA |
| 2-19 | 5 | 300 | 30 | 720 | 20 | 825 | 3.2 | 100 | 2.9 | 4.06 | NA | NA | NA |
| 2-20 | 5 | 300 | 30 | 720 | 45 | 709 | 4.5 | 7 | 1.8 | 3.10 | E | E | NA |

After quenching, the steel plates of Test Numbers 2-1 to 2-20 were subjected to tempering in a similar manner to Example 1. The tempering temperature (° C.) and tempering time (min) for each of the first tempering and the second tempering are shown in Table 4.

[Evaluation Tests]

A tensile test, a dislocation density measurement test, a specific precipitates numerical proportion measurement test, a block diameter measurement test and SSC resistance evaluation tests described hereunder were performed on the steel plates of Test Numbers 2-1 to 2-20 after the aforementioned tempering.

[Tensile Test]

A tensile test was performed on the steel plate of each test number in a similar manner to Example 1. The obtained yield strength is shown as "YS (MPa)" in Table 4.

[Dislocation Density Measurement Test]

In a similar manner to Example 1, a dislocation density measurement test was performed on the steel plate of each test number. The obtained dislocation density is shown in Table 4 as a dislocation density ρ ($\times 10^{14}$ $m^{-2}$). Further, Fn1 was determined based on Formula (1). The determined value for Fn1 is also shown in Table 4.

[Specific Precipitates Numerical Proportion Measurement Test]

A specific precipitates numerical proportion measurement test was performed on the steel plate of each test number in a similar manner to Example 1. The obtained numerical proportion of specific precipitates to fine precipitates is shown in Table 4 as a specific precipitates proportion (%).

[Mock Diameter Measurement Test]

A block diameter measurement test was performed on the steel plate of each test number in a similar manner to Example 1. The obtained block diameter (μm) is shown in Table 4.

[Tests to Evaluate SSC Resistance of Steel Material]

The SSC resistance of the steel plate of each test number was evaluated by a method in accordance with "Method A" of NACE TM0177-2005 and a four-point bending test. The method in accordance with Method A was performed in a similar manner to Example 1. The four-point bending test was performed in a similar manner to Example 1, except that the $H_2S$ gas that was sealed under pressure in an autoclave was $H_2S$ gas at a pressure of 2 atm and $H_2S$ gas at a pressure of 5 atm.

[Test Results]

The test results are shown in Table 4.

Referring to Table 3 and Table 4, the chemical composition of the respective steel plates of Test Numbers 2-1 to 2-13 was appropriate and the yield strength YS was within the range of 758 to less than 862 MPa (110 ksi grade). In addition, the specific precipitates proportion was 15% or more, the dislocation density ρ was not more than $3.0\times10^{14}$ ($m^{-2}$), and Fn1 was 2.90 or more. As a result, the aforementioned steel plates exhibited excellent SSC resistance in the SSC resistance test using $H_2S$ at 1 atm and the SSC resistance test using $H_2S$ at 2 atm.

In addition, the block diameter of the steel plates of Test Numbers 2-2, 2-5 and 2-12 were 1.5 μm or less. As a result, the aforementioned steel plates also exhibited even more excellent SSC resistance, that is, excellent SSC resistance in the SSC resistance test using $H_2S$ at 5 atm.

On the other hand, tempering at a low temperature was not performed for the steel plate of Test Number 2-14. Consequently, the specific precipitates proportion was less than 15%. In addition, the dislocation density ρ was more than $3.0\times10^{14}$ ($m^{-2}$). As a result, the steel plate of Test Number 2-14 did not exhibit excellent SSC resistance in the SSC resistance test using $H_2S$ at 2 atm.

Tempering at a low temperature was not performed for the steel plate of Test Number 2-15. Consequently, the specific precipitates proportion was less than 15%. In addition, the dislocation density ρ was more than $3.0\times10^{14}$ ($m^{-2}$). As a result, the steel plate of Test Number 2-15 did not exhibit excellent SSC resistance in the SSC resistance test using $H_2S$ at 1 atm and the SSC resistance test using $H_2S$ at 2 atm.

In the steel plate of Test Number 2-16, the V content was too low. In addition, tempering at a low temperature was performed after performing tempering at a high temperature. Consequently, the specific precipitates proportion was less than 15%. In addition, the dislocation density ρ was more than $3.0\times10^{14}$ ($m^{-2}$). As a result, the steel plate of Test Number 2-16 did not exhibit excellent SSC resistance in the SSC resistance test using $H_2S$ at 1 atm and the SSC resistance test using $H_2S$ at 2 atm.

In the steel plate of Test Number 2-17, the Mn content was too high. As a result, the steel plate of Test Number 2-17 did not exhibit excellent SSC resistance in the SSC resistance test using $H_2S$ at 1 atm and the SSC resistance test using $H_2S$ at 2 atm.

In the steel plate of Test Number 2-18, the Cr content was too low. As a result, the steel plate of Test Number 2-18 did not exhibit excellent SSC resistance in the SSC resistance test using $H_2S$ at 1 atm and the SSC resistance test using $H_2S$ at 2 atm.

In the steel plate of Test Number 2-19, the Mo content was too low. As a result, the steel plate of Test Number 2-19 did not exhibit excellent SSC resistance in the SSC resistance test using $H_2S$ at 1 atm and the SSC resistance test using $H_2S$ at 2 atm.

In the steel plate of Test Number 2-20, the V content was too low. As a result, the yield strength YS was less than 758 MPa, and a yield strength of 110 ksi grade was not obtained.

Example 3

In Example 3, the SSC resistance of a steel material having a yield strength of 125 ksi grade (862 to less than 965 MPa) was investigated. Specifically, molten steels of a weight of 180 kg having the chemical compositions shown in Table 5 were produced.

TABLE 5

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | V | Ti | B | N |
| 3-1 | 0.28 | 0.35 | 0.47 | 0.009 | 0.0008 | 0.025 | 0.99 | 0.72 | 0.15 | 0.010 | 0.0015 | 0.0024 |
| 3-2 | 0.33 | 0.35 | 0.35 | 0.008 | 0.0008 | 0.052 | 1.00 | 0.78 | 0.12 | 0.013 | 0.0011 | 0.0036 |
| 3-3 | 0.50 | 0.23 | 0.47 | 0.010 | 0.0008 | 0.037 | 1.05 | 0.67 | 0.15 | 0.014 | 0.0012 | 0.0034 |
| 3-4 | 0.51 | 0.28 | 0.40 | 0.007 | 0.0008 | 0.045 | 0.71 | 1.01 | 0.18 | 0.014 | 0.0014 | 0.0046 |
| 3-5 | 0.38 | 0.34 | 0.41 | 0.008 | 0.0009 | 0.043 | 0.96 | 0.76 | 0.13 | 0.010 | 0.0014 | 0.0043 |
| 3-6 | 0.28 | 0.24 | 0.42 | 0.011 | 0.0009 | 0.044 | 0.95 | 0.73 | 0.12 | 0.010 | 0.0013 | 0.0029 |
| 3-7 | 0.43 | 0.24 | 0.38 | 0.006 | 0.0007 | 0.034 | 1.00 | 0.70 | 0.11 | 0.014 | 0.0014 | 0.0024 |
| 3-8 | 0.41 | 0.30 | 0.44 | 0.011 | 0.0007 | 0.045 | 1.03 | 0.71 | 0.11 | 0.015 | 0.0014 | 0.0040 |
| 3-9 | 0.41 | 0.23 | 0.38 | 0.011 | 0.0009 | 0.046 | 0.95 | 0.73 | 0.12 | 0.014 | 0.0013 | 0.0042 |
| 3-10 | 0.27 | 0.32 | 0.36 | 0.009 | 0.0009 | 0.029 | 1.03 | 0.65 | 0.11 | 0.015 | 0.0011 | 0.0028 |
| 3-11 | 0.46 | 0.26 | 0.40 | 0.009 | 0.0009 | 0.029 | 0.95 | 0.63 | 0.13 | 0.011 | 0.0014 | 0.0032 |
| 3-12 | 0.40 | 0.28 | 0.47 | 0.008 | 0.0010 | 0.051 | 0.97 | 0.78 | 0.14 | 0.010 | 0.0015 | 0.0036 |
| 3-13 | 0.36 | 0.27 | 0.41 | 0.010 | 0.0007 | 0.050 | 1.03 | 0.75 | 0.08 | 0.012 | 0.0012 | 0.0047 |
| 3-14 | 0.27 | 0.27 | 0.42 | 0.012 | 0.0006 | 0.047 | 1.05 | 0.99 | 0.03 | 0.018 | 0.0015 | 0.0040 |
| 3-15 | 0.38 | 0.29 | 0.45 | 0.009 | 0.0010 | 0.051 | 0.95 | 0.92 | 0.09 | 0.015 | 0.0011 | 0.0044 |
| 3-16 | 0.24 | 0.29 | 0.40 | 0.006 | 0.0007 | 0.050 | 0.74 | 0.61 | — | 0.011 | 0.0012 | 0.0047 |
| 3-17 | 0.37 | 0.31 | 1.19 | 0.006 | 0.0010 | 0.039 | 1.03 | 0.67 | 0.11 | 0.009 | 0.0011 | 0.0026 |
| 3-18 | 0.43 | 0.28 | 0.45 | 0.011 | 0.0008 | 0.037 | 0.04 | 0.75 | 0.14 | 0.012 | 0.0013 | 0.0040 |
| 3-19 | 0.30 | 0.35 | 0.43 | 0.009 | 0.0008 | 0.050 | 1.04 | 0.11 | 0.08 | 0.014 | 0.0013 | 0.0026 |
| 3-20 | 0.26 | 0.30 | 0.42 | 0.008 | 0.0006 | 0.031 | 0.96 | 0.62 | — | 0.010 | 0.0014 | 0.0043 |

| Test | Chemical Composition (Unit is mass %; balance is Fe and impurities) | | | | | | | | | |
|---|---|---|---|---|---|---|---|---|---|---|
| Number | O | Nb | Ca | Mg | Zr | Co | W | Ni | Cu | Nd |
| 3-1 | 0.0017 | — | — | — | — | — | — | — | — | — |
| 3-2 | 0.0015 | — | — | — | — | — | — | — | — | — |
| 3-3 | 0.0012 | — | — | — | — | — | — | — | — | — |
| 3-4 | 0.0019 | — | — | — | — | — | — | — | — | — |
| 3-5 | 0.0011 | 0.012 | — | — | — | — | — | — | — | — |
| 3-6 | 0.0007 | — | 0.0016 | — | — | — | — | — | — | — |
| 3-7 | 0.0016 | — | — | 0.0014 | — | — | — | — | — | — |
| 3-8 | 0.0018 | — | — | — | 0.0018 | — | — | — | — | — |
| 3-9 | 0.0019 | — | — | — | — | 0.31 | — | — | — | — |
| 3-10 | 0.0018 | — | — | — | — | — | 0.32 | — | — | — |
| 3-11 | 0.0012 | — | — | — | — | — | — | 0.03 | — | — |
| 3-12 | 0.0011 | — | — | — | — | — | — | — | 0.22 | — |
| 3-13 | 0.0015 | — | — | — | — | — | — | — | — | 0.0020 |
| 3-14 | 0.0010 | 0.029 | — | — | — | — | — | — | 0.06 | — |
| 3-15 | 0.0017 | — | — | — | — | — | — | — | — | — |
| 3-16 | 0.0018 | 0.010 | — | — | — | — | — | — | — | — |
| 3-17 | 0.0014 | — | — | — | — | — | — | — | — | — |
| 3-18 | 0.0016 | — | — | — | — | — | — | — | — | — |
| 3-19 | 0.0009 | — | — | — | — | — | — | — | — | — |
| 3-20 | 0.0017 | — | — | — | — | — | — | — | — | — |

Steel plates having a thickness of 15 mm were produced in a similar manner to Example 1. Thereafter, quenching was performed in a similar manner to Example 1. Quenching was performed once for Test Number 3-4, and quenching was performed twice for Test Numbers 3-1 to 3-3 and Test Numbers 3-5 to 3-20. The other quenching conditions were the same as in Example 1.

The average cooling rate from 500° C. to 100° C. during quenching of the steel plate of Test Number 3-4, that is, the cooling rate during quenching ($CR_{500-100}$) (° C./sec), is shown in Table 6. The average cooling rate from 500° C. to 100° C. during the second quenching, that is, the cooling rate during quenching ($CR_{500-100}$) (° C./sec), of each of the steel plates of Test Numbers 3-1 to 3-3 and Test Numbers 3-5 to 3-20 is shown in Table 6. Here, the average cooling rate from 800° C. to 500° C. during quenching of the steel plate of Test Number 3-4 was within a range of 5 to 300° C./sec. Here, both the first quenching and the second quenching, the average cooling rate from 800° C. to 500° C. during quenching of the steel plate of Test Numbers 3-1 to 3-3 and Test Numbers 3-5 to 3-20 were within a range of 5 to 300° C./sec.

TABLE 6

| Test Number | Cooling Rate During Quenching $CR_{500-100}$ (° C./sec) | First Tempering Tempering Temperature (° C.) | First Tempering Tempering Time (min) | Second Tempering Tempering Temperature (° C.) | Second Tempering Tempering Time (min) | YS (MPa) | Block Diameter (μm) | Specific Precipitates Proportion (%) | Dislocation Density ρ ($\times 10^{14}$ $m^{-2}$) | SSC Resistance 1 atm $H_2S$ | SSC Resistance 2 atm $H_2S$ |
|---|---|---|---|---|---|---|---|---|---|---|---|
| 3-1 | 5 | 300 | 30 | 690 | 30 | 882 | 4.5 | 40 | 5.5 | E | NA |
| 3-2 | 10 | 300 | 30 | 690 | 60 | 907 | 1.5 | 27 | 5.5 | E | E |
| 3-3 | 5 | 300 | 30 | 700 | 60 | 914 | 2.3 | 50 | 4.7 | E | NA |
| 3-4 | 10 | 400 | 20 | 700 | 90 | 887 | 1.3 | 37 | 4.1 | E | E |
| 3-5 | 5 | 400 | 20 | 700 | 80 | 871 | 3.2 | 37 | 5.1 | E | NA |
| 3-6 | 5 | 350 | 30 | 690 | 45 | 869 | 4.4 | 33 | 5.3 | E | NA |
| 3-7 | 5 | 350 | 20 | 700 | 45 | 879 | 2.5 | 33 | 4.4 | E | NA |
| 3-8 | 5 | 200 | 70 | 700 | 30 | 886 | 2.8 | 33 | 4.5 | E | NA |
| 3-9 | 5 | 250 | 60 | 700 | 60 | 875 | 2.7 | 37 | 4.4 | E | NA |
| 3-10 | 5 | 400 | 20 | 680 | 60 | 925 | 4.5 | 37 | 6.3 | E | NA |
| 3-11 | 5 | 400 | 40 | 700 | 50 | 880 | 2.3 | 50 | 4.1 | E | NA |
| 3-12 | 10 | 300 | 40 | 700 | 50 | 873 | 1.4 | 33 | 3.7 | E | E |
| 3-13 | 5 | 300 | 40 | 700 | 70 | 868 | 3.5 | 23 | 5.0 | E | NA |
| 3-14 | 15 | 680 | 60 | — | — | 916 | 3.6 | 10 | 8.5 | NA | NA |
| 3-15 | 5 | 690 | 60 | — | — | 936 | 3.2 | 10 | 9.0 | NA | NA |
| 3-16 | 5 | 700 | 50 | 570 | 80 | 928 | 4.4 | 7 | 9.2 | NA | NA |
| 3-17 | 5 | 300 | 30 | 700 | 45 | 867 | 3.4 | 30 | 5.0 | NA | NA |
| 3-18 | 5 | 300 | 30 | 700 | 50 | 863 | 2.4 | 47 | 4.0 | NA | NA |
| 3-19 | 5 | 300 | 30 | 680 | 50 | 891 | 3.9 | 100 | 5.7 | NA | NA |
| 3-20 | 5 | 300 | 30 | 690 | 60 | 836 | 4.6 | 10 | 5.1 | E | NA |

After quenching, the steel plates of Test Numbers 3-1 to 3-20 were subjected to tempering in a similar manner to Example 1. The tempering temperature (° C.) and tempering time (min) for each of the first tempering and the second tempering are shown in Table 6.

[Evaluation Tests]

A tensile test, a dislocation density measurement test, a specific precipitates numerical proportion measurement test, a block diameter measurement test and SSC resistance evaluation tests described hereunder were performed on the steel plates of Test Numbers 3-1 to 3-20 after the aforementioned tempering.

[Tensile Test]

A tensile test was performed on the steel plate of each test number in a similar manner to Example 1. The obtained yield strength is shown as "YS (MPa)" in Table 6.

[Dislocation Density Measurement Test]

In a similar manner to Example 1, a dislocation density measurement test was performed on the steel plate of each test number. The obtained dislocation density is shown in Table 6 as a dislocation density ρ ($\times 10^{14}$ $m^2$).

[Specific Precipitates Numerical Proportion Measurement Test]

A specific precipitates numerical proportion measurement test was performed on the steel plate of each test number in a similar manner to Example 1. The obtained numerical proportion of specific precipitates to fine precipitates is shown in Table 6 as a specific precipitates proportion N.

[Block Diameter Measurement Test]

A block diameter measurement test was performed on the steel plate of each test number in a similar manner to Example 1. The obtained block diameter (μm) is shown in Table 6.

[Tests to Evaluate SSC Resistance of Steel Material]

The SSC resistance of the steel plate of each test number was evaluated by a method in accordance with "Method A" of NACE TM0177-2005, and a four-point bending test. The method in accordance with Method A was performed in a similar manner to Example 1. The four-point bending test was performed in a similar manner to Example 1, except that the $H_2S$ gas that was sealed under pressure in an autoclave was $H_2S$ gas at a pressure of 2 atm.

[Test Results]

The test results are shown in Table 6.

Referring to Table 5 and Table 6, the chemical composition of the respective steel plates of Test Numbers 3-1 to 3-13 was appropriate and the yield strength YS was within the range of 862 to less than 965 MPa (125 ksi grade). In addition, the specific precipitates proportion was 15% or more, and the dislocation density ρ was within the range of more than $3.0\times10^{14}$ to $7.0\times10^{14}$ ($m^{-2}$). As a result, the aforementioned steel plates exhibited excellent SSC resistance in the SSC resistance test using $H_2S$ at 1 atm.

In addition, the block diameter of the steel plates of Test Numbers 3-2, 3-4 and 3-12 were 1.5 μm or less. As a result, the aforementioned steel plates also exhibited even more excellent SSC resistance, that is, excellent SSC resistance in the SSC resistance test using $H_2S$ at 2 atm.

On the other hand, tempering at a low temperature was not performed for the steel plate of Test Number 3-14. Consequently, the specific precipitates proportion was less than 15%. In addition, the dislocation density ρ was more than $7.0\times10^{14}$ ($m^{-2}$). As a result, the steel plate of Test Number 3-14 did not exhibit excellent SSC resistance in the SSC resistance test using $H_2S$ at 1 atm.

Tempering at a low temperature was not performed for the steel plate of Test Number 3-15. Consequently, the specific precipitates proportion was less than 15%. In addition, the dislocation density ρ was more than $7.0\times10^{14}$ ($m^{-2}$). As a result, the steel plate of Test Number 3-15 did not exhibit excellent SSC resistance in the SSC resistance test using $H_2S$ at 1 atm.

In the steel plate of Test Number 3-16, the V content was too low. In addition, tempering at a low temperature was performed after performing tempering at a high temperature. Consequently, the specific precipitates proportion was less than 15%. In addition, the dislocation density ρ was more than $7.0\times10^{14}$ ($m^{-2}$). As a result, the steel plate of Test Number 3-16 did not exhibit excellent SSC resistance in the SSC resistance test using $H_2S$ at 1 atm.

In the steel plate of Test Number 3-17, the Mn content was too high. As a result, the steel plate of Test Number 3-17 did not exhibit excellent SSC resistance in the SSC resistance test using $H_2S$ at 1 atm.

In the steel plate of Test Number 3-18, the Cr content was too low. As a result, the steel plate of Test Number 3-18 did not exhibit excellent SSC resistance in the SSC resistance test using $H_2S$ at 1 atm.

In the steel plate of Test Number 3-19, the Mo content was too low. As a result, the steel plate of Test Number 3-19 did not exhibit excellent SSC resistance in the SSC resistance test using $H_2S$ at 1 atm.

In the steel plate of Test Number 3-20, the V content was too low. Consequently, the specific precipitates proportion was less than 15%. In addition, the yield strength YS was less than 862 MPa, and a yield strength of 125 ksi grade was not obtained.

Example 4

In Example 4, the SSC resistance of a steel material having a yield strength of 140 ksi grade (965 to less than 1069 MPa) was investigated. Specifically, molten steels of a weight of 180 kg having the chemical compositions shown in Table 7 were produced.

TABLE 7

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | V | Ti | B | N |
| 4-1 | 0.26 | 0.33 | 0.41 | 0.006 | 0.0010 | 0.034 | 1.05 | 0.73 | 0.10 | 0.014 | 0.0015 | 0.0038 |
| 4-2 | 0.42 | 0.22 | 0.37 | 0.008 | 0.0008 | 0.045 | 0.98 | 0.74 | 0.13 | 0.014 | 0.0012 | 0.0031 |
| 4-3 | 0.36 | 0.28 | 0.35 | 0.009 | 0.0008 | 0.039 | 1.00 | 0.68 | 0.14 | 0.015 | 0.0012 | 0.0024 |
| 4-4 | 0.33 | 0.33 | 0.42 | 0.006 | 0.0009 | 0.054 | 0.97 | 0.68 | 0.13 | 0.010 | 0.0012 | 0.0026 |
| 4-5 | 0.43 | 0.28 | 0.39 | 0.011 | 0.0006 | 0.036 | 1.05 | 0.71 | 0.13 | 0.013 | 0.0011 | 0.0027 |
| 4-6 | 0.27 | 0.24 | 0.46 | 0.008 | 0.0009 | 0.041 | 1.03 | 0.74 | 0.13 | 0.013 | 0.0011 | 0.0026 |
| 4-7 | 0.47 | 0.29 | 0.45 | 0.006 | 0.0007 | 0.030 | 1.05 | 0.71 | 0.14 | 0.010 | 0.0011 | 0.0037 |
| 4-8 | 0.50 | 0.24 | 0.39 | 0.006 | 0.0006 | 0.038 | 1.04 | 0.78 | 0.09 | 0.011 | 0.0012 | 0.0026 |
| 4-9 | 0.43 | 0.28 | 0.36 | 0.009 | 0.0008 | 0.050 | 0.98 | 0.78 | 0.08 | 0.014 | 0.0013 | 0.0031 |
| 4-10 | 0.40 | 0.25 | 0.37 | 0.012 | 0.0006 | 0.041 | 0.95 | 0.63 | 0.10 | 0.014 | 0.0014 | 0.0035 |
| 4-11 | 0.41 | 0.24 | 0.44 | 0.012 | 0.0010 | 0.046 | 1.05 | 0.70 | 0.11 | 0.009 | 0.0011 | 0.0047 |
| 4-12 | 0.35 | 0.27 | 0.38 | 0.007 | 0.0010 | 0.038 | 1.02 | 0.74 | 0.08 | 0.011 | 0.0013 | 0.0042 |
| 4-13 | 0.37 | 0.23 | 0.35 | 0.009 | 0.0006 | 0.043 | 1.04 | 0.74 | 0.13 | 0.014 | 0.0015 | 0.0047 |
| 4-14 | 0.25 | 0.22 | 0.45 | 0.011 | 0.0007 | 0.032 | 0.98 | 1.00 | 0.03 | 0.019 | 0.0015 | 0.0030 |
| 4-15 | 0.28 | 0.30 | 0.41 | 0.006 | 0.0010 | 0.035 | 0.98 | 0.94 | 0.09 | 0.010 | 0.0011 | 0.0027 |
| 4-16 | 0.25 | 0.24 | 0.41 | 0.011 | 0.0009 | 0.053 | 0.74 | 0.76 | — | 0.014 | 0.0015 | 0.0022 |
| 4-17 | 0.41 | 0.35 | 1.22 | 0.010 | 0.0006 | 0.032 | 1.03 | 0.75 | 0.15 | 0.015 | 0.0013 | 0.0028 |
| 4-18 | 0.46 | 0.29 | 0.38 | 0.008 | 0.0008 | 0.030 | 0.05 | 0.74 | 0.13 | 0.012 | 0.0013 | 0.0039 |
| 4-19 | 0.47 | 0.26 | 0.47 | 0.009 | 0.0010 | 0.047 | 1.03 | 0.04 | 0.15 | 0.013 | 0.0011 | 0.0034 |
| 4-20 | 0.27 | 0.24 | 0.35 | 0.012 | 0.0008 | 0.026 | 1.05 | 0.78 | — | 0.015 | 0.0013 | 0.0036 |

| Test | Chemical Composition (Unit is mass %; balance is Fe and impurities) | | | | | | | | | |
|---|---|---|---|---|---|---|---|---|---|---|
| Number | O | Nb | Ca | Mg | Zr | Co | W | Ni | Cu | Nd |
| 4-1 | 0.0019 | — | — | — | — | — | — | — | — | — |
| 4-2 | 0.0013 | — | — | — | — | — | — | — | — | — |
| 4-3 | 0.0015 | — | — | — | — | — | — | — | — | — |
| 4-4 | 0.0018 | — | — | — | — | — | — | — | — | — |
| 4-5 | 0.0006 | 0.015 | — | — | — | — | — | — | — | — |
| 4-6 | 0.0008 | — | 0.0019 | — | — | — | — | — | — | — |
| 4-7 | 0.0009 | — | — | 0.0014 | — | — | — | — | — | — |
| 4-8 | 0.0007 | — | — | — | 0.0015 | — | — | — | — | — |
| 4-9 | 0.0008 | — | — | — | — | 0.28 | — | — | — | — |
| 4-10 | 0.0011 | — | — | — | — | — | 0.24 | — | — | — |
| 4-11 | 0.0019 | — | — | — | — | — | — | 0.02 | — | — |
| 4-12 | 0.0010 | — | — | — | — | — | — | — | 0.18 | — |
| 4-13 | 0.0007 | — | — | — | — | — | — | — | — | 0.0010 |
| 4-14 | 0.0019 | 0.028 | — | — | — | — | — | — | 0.05 | — |
| 4-15 | 0.0015 | — | — | — | — | — | — | — | — | — |
| 4-16 | 0.0014 | 0.009 | — | — | — | — | — | — | — | — |
| 4-17 | 0.0010 | — | — | — | — | — | — | — | — | — |
| 4-18 | 0.0009 | — | — | — | — | — | — | — | — | — |
| 4-19 | 0.0016 | — | — | — | — | — | — | — | — | — |
| 4-20 | 0.0019 | — | — | — | — | — | — | — | — | — |

Steel plates having a thickness of 15 mm were produced in a similar manner to Example 1. Thereafter, quenching was performed in a similar manner to Example 1. Quenching was performed once for Test Number 4-4, and quenching was performed twice for Test Numbers 4-1 to 4-3 and Test Numbers 4-5 to 4-20. The other quenching conditions were the same as in Example 1.

The average cooling rate from 500° C. to 100° C. during quenching of the steel plate of Test Number 4-4, that is, the cooling rate during quenching ($CR_{500-100}$) (° C./sec), is shown in Table 8. The average cooling rate from 500° C. to 100° C. during the second quenching, that is, the cooling rate during quenching ($CR_{500-100}$) (° C./sec), of each of the steel plates of Test Numbers 4-1 to 4-3 and Test Numbers 4-5 to 4-20 is shown in Table 8. Here, the average cooling rate from 800° C. to 500° C. during quenching of the steel plate of Test Number 4-4 was within a range of 5 to 300° C./sec. Here, both the first quenching and the second quenching, the average cooling rate from 800° C. to 500° C. during quenching of the steel plate of Test Numbers 4-1 to 4-3 and Test Numbers 4-5 to 4-20 were within a range of 5 to 300° C./sec.

test number. The obtained dislocation density is shown in Table 8 as a dislocation density ρ ($\times 10^{14}$ $m^{-2}$).

[Specific Precipitates Numerical Proportion Measurement Test]

A specific precipitates numerical proportion measurement test was performed on the steel plate of each test number in a similar manner to Example 1. The obtained numerical proportion of specific precipitates to fine precipitates is shown in Table 8 as a specific precipitates proportion (%).

[Mock Diameter Measurement Test]

A block diameter measurement test was performed on the steel plate of each test number in a similar manlier to Example 1. The obtained block diameter (μm) is shown in Table 8.

[Tests to Evaluate SSC Resistance of Steel Material]

The SSC resistance of the steel plate of each test number was evaluated by a method in accordance with "Method A" of NACE TM0177-2005. In a similar manner to Example 1, round bar test specimens were taken from the steel plate of each test number. A stress was applied to the round bar test specimens in a similar manner to Example 1.

TABLE 8

| | Cooling Rate | First Tempering | | Second Tempering | | | | Specific | Disloca- | | |
|---|---|---|---|---|---|---|---|---|---|---|---|
| | During Quenching | Tempering Temper- | Tempering | Tempering Temper- | Tempering | | Block | Precip- itates | tion Density ρ | SSC Resistance | |
| Test Number | $CR_{500-100}$ (° C./sec) | ature (° C.) | Time (min) | ature (° C.) | Time (min) | YS (MPa) | Diameter (μm) | Propor- tion (%) | ($\times 10^{14}$ $m^{-2}$) | 0.1 atm $H_2S$ | 0.3 atm $H_2S$ |
| 4-1 | 5 | 350 | 30 | 660 | 80 | 1036 | 4.6 | 23 | 14.0 | E | NA |
| 4-2 | 10 | 300 | 20 | 680 | 60 | 993 | 1.2 | 33 | 8.3 | E | E |
| 4-3 | 5 | 300 | 20 | 680 | 60 | 969 | 3.5 | 40 | 9.8 | E | NA |
| 4-4 | 10 | 400 | 20 | 670 | 70 | 1013 | 1.5 | 30 | 12.3 | E | E |
| 4-5 | 5 | 400 | 60 | 680 | 30 | 1003 | 2.8 | 43 | 8.8 | E | NA |
| 4-6 | 5 | 350 | 30 | 670 | 50 | 991 | 4.5 | 30 | 12.1 | E | NA |
| 4-7 | 5 | 350 | 20 | 690 | 45 | 968 | 2.1 | 40 | 7.1 | E | NA |
| 4-8 | 5 | 200 | 70 | 680 | 45 | 1024 | 1.8 | 23 | 9.9 | E | NA |
| 4-9 | 5 | 250 | 60 | 680 | 60 | 978 | 2.7 | 23 | 7.8 | E | NA |
| 4-10 | 5 | 400 | 20 | 680 | 60 | 969 | 2.9 | 37 | 7.3 | E | NA |
| 4-11 | 5 | 400 | 40 | 670 | 50 | 1014 | 2.8 | 27 | 10.8 | E | NA |
| 4-12 | 10 | 300 | 40 | 680 | 50 | 967 | 1.4 | 23 | 8.9 | E | E |
| 4-13 | 5 | 300 | 40 | 670 | 70 | 1002 | 3.3 | 33 | 12.7 | E | NA |
| 4-14 | 15 | 670 | 60 | — | — | 978 | 3.7 | 10 | 15.8 | NA | NA |
| 4-15 | 5 | 670 | 60 | — | — | 985 | 4.3 | 10 | 18.4 | NA | NA |
| 4-16 | 5 | 680 | 30 | 550 | 60 | 965 | 4.5 | 7 | 17.2 | NA | NA |
| 4-17 | 5 | 300 | 30 | 680 | 45 | 1001 | 2.9 | 33 | 11.2 | NA | NA |
| 4-18 | 5 | 300 | 30 | 680 | 50 | 1012 | 2.2 | 43 | 10.3 | NA | NA |
| 4-19 | 5 | 300 | 30 | 680 | 50 | 1011 | 2.0 | 100 | 9.9 | NA | NA |
| 4-20 | 5 | 300 | 30 | 670 | 60 | 935 | 4.5 | 7 | 14.0 | E | NA |

After quenching, the steel plates of Test Numbers 4-1 to 4-20 were subjected to tempering in a similar manner to Example 1. The tempering temperature (° C.) and tempering time (min) for each of the first tempering and the second tempering are shown in Table 8.

[Evaluation Tests]

A tensile test, a dislocation density measurement test, a specific precipitates numerical proportion measurement test, a block diameter measurement test and SSC resistance evaluation tests described hereunder were performed on the steel plates of Test Numbers 4-1 to 4-20 after the aforementioned tempering.

[Tensile Test]

A tensile test was performed on the steel plate of each test number in a similar manner to Example 1. The obtained yield strength is shown as "YS (MPa)" in Table 8.

[Dislocation Density Measurement Test]

In a similar manner to Example 1, a dislocation density measurement test was performed on the steel plate of each A mixed aqueous solution containing 5.0 mass % of sodium chloride and 0.4 mass % of sodium acetate that was adjusted to pH 3.5 using acetic acid (NACE solution B) was used as the test solution. The test solution at 24° C. was poured into three test vessels, and these were adopted as test baths. Three round bar test specimens to which the stress was applied were immersed individually in the test bath of mutually different test vessels. After each test bath was degassed, $H_2S$ gas at 0.1 atm and $CO_2$ gas at 0.9 atm were blown into the test baths and caused to saturate. The test baths in which the $H_2S$ gas at 0.1 atm and the $CO_2$ gas at 0.9 atm were saturated were held at 24° C. for 720 hours.

In addition, the test solution at 24° C. was poured into three test vessels, and these were adopted as test baths. Three round bar test specimens other than the aforementioned three round bar test specimens among the round bar test specimens to which stress was applied were individually immersed in the test baths of mutually different test vessels.

After each test bath was degassed, $H_2S$ gas at 0.3 atm and $CO_2$ gas at 0.7 atm were blown into the test baths and caused to saturate. The test baths in which the $H_2S$ gas at 0.3 atm and the $CO_2$ gas at 0.7 atm were saturated were held at 24° C. for 720 hours.

The other test conditions were the same as the method in accordance with "Method A" of NACE TM0177-2005 that was performed in Example 1.

[Test Results]

The test results are shown in Table 8.

Referring to Table 7 and Table 8, the chemical composition of the respective steel plates of Test Numbers 4-1 to 4-13 was appropriate and the yield strength YS was within the range of 965 to less than 1069 MPa (140 ksi grade). In addition, the specific precipitates proportion was 15% or more, and the dislocation density ρ was within the range of more than $7.0\times10^{14}$ to $15.0\times10^{14}$ ($m^{-2}$). As a result, the aforementioned steel plates exhibited excellent SSC resistance in the SSC resistance test using $H_2S$ at 0.1 atm.

In addition, the block diameters of the steel plates of Test Numbers 4-2, 4-4 and 4-12 were 1.5 μm or less. As a result, the aforementioned steel plates also exhibited even more excellent SSC resistance, that is, excellent SSC resistance in the SSC resistance test using $H_2S$ at 0.3 atm.

On the other hand, tempering at a low temperature was not performed for the steel plate of Test Number 4-14. Consequently, the specific precipitates proportion was less than 15%. In addition, the dislocation density ρ was more than $15.0\times10^{14}$ ($m^{-2}$). As a result, the steel plate of Test Number 4-14 did not exhibit excellent SSC resistance in the SSC resistance test using $H_2S$ at 0.1 atm.

Tempering at a low temperature was not performed for the steel plate of Test Number 4-15. Consequently, the specific precipitates proportion was less than 15%. In addition, the dislocation density ρ was more than $15.0\times10^{14}$ ($m^2$). As a result, the steel plate of Test Number 4-15 did not exhibit excellent SSC resistance in the SSC resistance test using $H_2S$ at 0.1 atm.

In the steel plate of Test Number 4-16, the V content was too low. In addition, tempering at a low temperature was performed after performing tempering at a high temperature. Consequently, the specific precipitates proportion was less than 15%. In addition, the dislocation density ρ was more than $15.0\times10^{14}$ ($m^{-2}$). As a result, the steel plate of Test Number 4-16 did not exhibit excellent SSC resistance in the SSC resistance test using $H_2S$ at 0.1 atm.

In the steel plate of Test Number 4-17, the Mn content was too high. As a result, the steel plate of Test Number 4-17 did not exhibit excellent SSC resistance in the SSC resistance test using $H_2S$ at 0.1 atm.

In the steel plate of Test Number 4-18, the Cr content was too low. As a result, the steel plate of Test Number 4-18 did not exhibit excellent SSC resistance in the SSC resistance test using $H_2S$ at 0.1 atm.

In the steel plate of Test Number 4-19, the Mo content was too low. As a result, the steel plate of Test Number 4-19 did not exhibit excellent SSC resistance in the SSC resistance test using $H_2S$ at 0.1 atm.

In the steel plate of Test Number 4-20, the V content was too low. Consequently, the specific precipitates proportion was less than 15%. In addition, the yield strength YS was less than 965 MPa, and a yield strength of 140 ksi grade was not obtained.

Example 5

In Example 5, the SSC resistance of a steel material having a yield strength of 155 ksi grade (1069 to 1172 MPa) was investigated. Specifically, molten steels of a weight of 180 kg having the chemical compositions shown in Table 9 were produced.

TABLE 9

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | V | Ti | B | N |
| 5-1 | 0.27 | 0.25 | 0.46 | 0.007 | 0.0006 | 0.050 | 1.04 | 0.63 | 0.12 | 0.009 | 0.0015 | 0.0026 |
| 5-2 | 0.52 | 0.30 | 0.47 | 0.011 | 0.0010 | 0.048 | 0.98 | 0.70 | 0.09 | 0.014 | 0.0011 | 0.0039 |
| 5-3 | 0.53 | 0.27 | 0.37 | 0.009 | 0.0008 | 0.055 | 1.01 | 0.73 | 0.12 | 0.010 | 0.0011 | 0.0043 |
| 5-4 | 0.32 | 0.26 | 0.39 | 0.006 | 0.0009 | 0.044 | 1.01 | 0.77 | 0.15 | 0.013 | 0.0015 | 0.0035 |
| 5-5 | 0.38 | 0.24 | 0.47 | 0.009 | 0.0008 | 0.025 | 0.98 | 0.78 | 0.11 | 0.015 | 0.0014 | 0.0048 |
| 5-6 | 0.32 | 0.30 | 0.45 | 0.007 | 0.0008 | 0.041 | 1.03 | 0.66 | 0.11 | 0.013 | 0.0013 | 0.0039 |
| 5-7 | 0.35 | 0.27 | 0.45 | 0.010 | 0.0008 | 0.049 | 0.96 | 0.69 | 0.13 | 0.015 | 0.0015 | 0.0027 |
| 5-8 | 0.29 | 0.24 | 0.35 | 0.011 | 0.0008 | 0.054 | 0.99 | 0.71 | 0.10 | 0.009 | 0.0013 | 0.0042 |
| 5-9 | 0.26 | 0.28 | 0.39 | 0.008 | 0.0006 | 0.027 | 0.97 | 0.74 | 0.13 | 0.010 | 0.0014 | 0.0046 |
| 5-10 | 0.48 | 0.31 | 0.39 | 0.006 | 0.0010 | 0.047 | 0.98 | 0.67 | 0.09 | 0.014 | 0.0012 | 0.0027 |
| 5-11 | 0.27 | 0.28 | 0.36 | 0.012 | 0.0008 | 0.042 | 0.98 | 0.76 | 0.09 | 0.014 | 0.0014 | 0.0026 |
| 5-12 | 0.53 | 0.35 | 0.35 | 0.011 | 0.0007 | 0.046 | 1.05 | 0.69 | 0.10 | 0.010 | 0.0012 | 0.0047 |
| 5-13 | 0.29 | 0.29 | 0.46 | 0.008 | 0.0006 | 0.041 | 1.02 | 0.64 | 0.09 | 0.010 | 0.0014 | 0.0041 |
| 5-14 | 0.27 | 0.30 | 0.42 | 0.012 | 0.0010 | 0.038 | 1.00 | 0.99 | 0.03 | 0.020 | 0.0013 | 0.0038 |
| 5-15 | 0.33 | 0.23 | 0.37 | 0.012 | 0.0010 | 0.034 | 1.03 | 0.88 | 0.08 | 0.009 | 0.0011 | 0.0025 |
| 5-16 | 0.25 | 0.31 | 0.43 | 0.008 | 0.0009 | 0.050 | 1.02 | 0.76 | — | 0.015 | 0.0011 | 0.0027 |
| 5-17 | 0.26 | 0.30 | 1.34 | 0.011 | 0.0006 | 0.027 | 1.05 | 0.70 | 0.14 | 0.014 | 0.0011 | 0.0034 |
| 5-18 | 0.51 | 0.22 | 0.47 | 0.007 | 0.0007 | 0.036 | 0.03 | 0.74 | 0.11 | 0.009 | 0.0015 | 0.0023 |
| 5-19 | 0.49 | 0.33 | 0.45 | 0.008 | 0.0006 | 0.044 | 0.98 | 0.10 | 0.13 | 0.011 | 0.0013 | 0.0028 |
| 5-20 | 0.26 | 0.26 | 0.41 | 0.012 | 0.0008 | 0.045 | 1.00 | 0.74 | — | 0.013 | 0.0012 | 0.0030 |

| Test | Chemical Composition (Unit is mass %; balance is Fe and impurities) | | | | | | | | | |
|---|---|---|---|---|---|---|---|---|---|---|
| Number | O | Nb | Ca | Mg | Zr | Co | W | Ni | Cu | Nd |
| 5-1 | 0.0017 | — | — | — | — | — | — | — | — | — |
| 5-2 | 0.0013 | — | — | — | — | — | — | — | — | — |
| 5-3 | 0.0013 | — | — | — | — | — | — | — | — | — |
| 5-4 | 0.0015 | — | — | — | — | — | — | — | — | — |
| 5-5 | 0.0006 | 0.016 | — | — | — | — | — | — | — | — |
| 5-6 | 0.0015 | — | 0.0020 | — | — | — | — | — | — | — |

TABLE 9-continued

| | | | | | | | | | | |
|---|---|---|---|---|---|---|---|---|---|---|
| 5-7 | 0.0007 | — | — | 0.0011 | — | — | — | — | — | — |
| 5-8 | 0.0015 | — | — | — | 0.0014 | — | — | — | — | — |
| 5-9 | 0.0010 | — | — | — | — | 0.27 | — | — | — | — |
| 5-10 | 0.0009 | — | — | — | — | — | 0.22 | — | — | — |
| 5-11 | 0.0008 | — | — | — | — | — | — | 0.02 | — | — |
| 5-12 | 0.0016 | — | — | — | — | — | — | — | 0.17 | — |
| 5-13 | 0.0017 | — | — | — | — | — | — | — | — | 0.0020 |
| 5-14 | 0.0017 | 0.030 | — | — | — | — | — | — | 0.08 | — |
| 5-15 | 0.0012 | — | — | — | — | — | — | — | — | — |
| 5-16 | 0.0019 | 0.007 | — | — | — | — | — | — | — | — |
| 5-17 | 0.0007 | — | — | — | — | — | — | — | — | — |
| 5-18 | 0.0011 | — | — | — | — | — | — | — | — | — |
| 5-19 | 0.0013 | — | — | — | — | — | — | — | — | — |
| 5-20 | 0.0006 | — | — | — | — | — | — | — | — | — |

Steel plates having a thickness of 15 mm were produced in a similar manner to Example 1. Thereafter, quenching was performed in a similar manner to Example 1. Quenching was performed once for Test Number 5-4, and quenching was performed twice for Test Numbers 5-1 to 5-3 and Test Numbers 5-5 to 5-20. The other quenching conditions were the same as in Example 1.

The average cooling rate from 500° C. to 100° C. during quenching of the steel plate of Test Number 5-4, that is, the cooling rate during quenching ($CR_{500400}$) (° C./sec), is shown in Table 10. The average cooling rate from 500° C. to 100° C. during the second quenching, that is, the cooling rate during quenching ($CR_{500-100}$) (° C./sec), of each of the steel plates of Test Numbers 5-1 to 5-3 and Test Numbers 5-5 to 5-20 is shown in Table 10. Here, the average cooling rate from 800° C. to 500° C. during quenching of the steel plate of Test Number 5-4 was within a range of 5 to 300° C./sec. Here, both the first quenching and the second quenching, the average cooling rate from 800° C. to 500° C. during quenching of the steel plate of Test Numbers 5-1 to 5-3 and Test Numbers 5-5 to 5-20 were within a range of 5 to 300° C./sec.

After quenching, the steel plates of Test Numbers 5-1 to 5-20 were subjected to tempering in a similar manlier to Example 1. The tempering temperature (° C.) and tempering time (min) for each of the first tempering and the second tempering are shown in Table 10.

[Evaluation Tests]

A tensile test, a dislocation density measurement test, a specific precipitates numerical proportion measurement test, a block diameter measurement test and SSC resistance evaluation tests described hereunder were performed on the steel plates of Test Numbers 5-1 to 5-20 after the aforementioned tempering.

[Tensile Test]

A tensile test was performed on the steel plate of each test number in a similar manner to Example 1. The obtained yield strength is shown as "YS (MPa)" in Table 10.

[Dislocation Density Measurement Test]

In a similar manner to Example 1, a dislocation density measurement test was performed on the steel plate of each test number. The obtained dislocation density is shown in Table 10 as a dislocation density ρ ($\times 10^{15}$ $m^{-2}$).

TABLE 10

| | Cooling Rate | First Tempering | | Second Tempering | | | | Specific | Disloca- | | |
|---|---|---|---|---|---|---|---|---|---|---|---|
| | During Quenching | Tempering Temper- | Tempering | Tempering Temper- | Tempering | | Block | Precip- | tion | SSC Resistance | |
| Test Number | $CR_{500-100}$ (° C./sec) | ature (° C.) | Time (min) | ature (° C.) | Time (min) | YS (MPa) | Diameter (μm) | itates Propor- tion (%) | Density ρ ($\times 10^{15}$ $m^{-2}$) | 0.01 atm $H_2S$ | 0.03 atm $H_2S$ |
| 5-1 | 5 | 350 | 30 | 640 | 60 | 1152 | 4.0 | 33 | 2.9 | E | NA |
| 5-2 | 10 | 300 | 20 | 670 | 60 | 1102 | 1.1 | 27 | 1.7 | E | E |
| 5-3 | 5 | 300 | 20 | 670 | 70 | 1098 | 1.6 | 30 | 1.7 | E | NA |
| 5-4 | 10 | 400 | 20 | 660 | 70 | 1080 | 1.5 | 37 | 1.7 | E | E |
| 5-5 | 5 | 400 | 60 | 660 | 30 | 1105 | 3.2 | 27 | 2.3 | E | NA |
| 5-6 | 5 | 350 | 30 | 660 | 50 | 1089 | 3.8 | 30 | 2.0 | E | NA |
| 5-7 | 5 | 350 | 20 | 660 | 45 | 1094 | 3.6 | 37 | 2.1 | E | NA |
| 5-8 | 5 | 200 | 70 | 650 | 45 | 1107 | 3.9 | 23 | 2.4 | E | NA |
| 5-9 | 5 | 250 | 60 | 650 | 60 | 1099 | 4.2 | 27 | 2.2 | E | NA |
| 5-10 | 5 | 400 | 20 | 670 | 60 | 1082 | 1.9 | 30 | 1.6 | E | NA |
| 5-11 | 5 | 400 | 40 | 650 | 50 | 1101 | 3.9 | 20 | 2.3 | E | NA |
| 5-12 | 10 | 300 | 40 | 670 | 50 | 1096 | 1.2 | 27 | 1.6 | E | E |
| 5-13 | 5 | 300 | 40 | 650 | 70 | 1105 | 3.8 | 23 | 2.4 | E | NA |
| 5-14 | 15 | 640 | 60 | — | — | 1154 | 3.6 | 10 | 4.2 | NA | NA |
| 5-15 | 5 | 650 | 60 | — | — | 1149 | 3.5 | 10 | 4.1 | NA | NA |
| 5-16 | 5 | 640 | 50 | 550 | 60 | 1138 | 4.3 | 7 | 4.0 | NA | NA |
| 5-17 | 5 | 300 | 30 | 650 | 45 | 1097 | 4.1 | 30 | 2.1 | NA | NA |
| 5-18 | 5 | 300 | 30 | 670 | 50 | 1093 | 1.7 | 33 | 1.8 | NA | NA |
| 5-19 | 5 | 300 | 30 | 670 | 50 | 1083 | 1.9 | 100 | 1.7 | NA | NA |
| 5-20 | 5 | 300 | 30 | 650 | 60 | 1051 | 4.1 | 7 | 2.7 | E | NA |

[Specific Precipitates Numerical Proportion Measurement Test]

A specific precipitates numerical proportion measurement test was performed on the steel plate of each test number in a similar manner to Example 1. The obtained numerical proportion of specific precipitates to fine precipitates is shown in Table 10 as a specific precipitates proportion (%).

[Block Diameter Measurement Test]

A block diameter measurement test was performed on the steel plate of each test number in a similar manner to Example 1. The obtained block diameter (μm) is shown in Table 10.

[Tests to Evaluate SSC Resistance of Steel Material]

The SSC resistance of the steel plate of each test number was evaluated by a method in accordance with "Method A" of NACE TM0177-2005. The method in accordance with Method A was performed in a similar manner to Example 4, except that $H_2S$ gas at 0.01 atm and $CO_2$ gas at 0.99 atm, and $H_2S$ gas at 0.03 atm and $CO_2$ gas at 0.97 atm were used as the gases that were blown into the test vessels.

[Test Results]

The test results are shown in Table 10.

Referring to Table 9 and Table 10, the chemical composition of the respective steel plates of Test Numbers 5-1 to 5-13 was appropriate and the yield strength YS was within the range of 1069 to 1172 MPa (155 ksi grade). In addition, the specific precipitates proportion was 15% or more, and the dislocation density ρ was within the range of more than $1.5\times10^{15}$ to $3.5\times10^{15}$ ($m^{-2}$). As a result, the aforementioned steel plates exhibited excellent SSC resistance in the SSC resistance test using $H_2S$ at 0.01 atm.

In addition, the block diameters of the steel plates of Test Numbers 5-2, 5-4 and 5-12 were 1.5 μm or less. As a result, the aforementioned steel plates also exhibited even more excellent SSC resistance, that is, excellent SSC resistance in the SSC resistance test using $H_2S$ at 0.03 atm.

On the other hand, tempering at a low temperature was not performed for the steel plate of Test Number 5-14. Consequently, the specific precipitates proportion was less than 15%. In addition, the dislocation density ρ was more than $3.5\times10^{15}$ ($m^{-2}$). As a result, the steel plate of Test Number 5-14 did not exhibit excellent SSC resistance in the SSC resistance test using $H_2S$ at 0.01 atm.

Tempering at a low temperature was not performed for the steel plate of Test Number 5-15. Consequently, the specific precipitates proportion was less than 15%. In addition, the dislocation density ρ was more than $3.5\times10^{15}$ ($m^{-2}$). As a result, the steel plate of Test Number 5-15 did not exhibit excellent SSC resistance in the SSC resistance test using $H_2S$ at 0.01 atm.

In the steel plate of Test Number 5-16, the V content was too low. In addition, tempering at a low temperature was performed after performing tempering at a high temperature. Consequently, the specific precipitates proportion was less than 15%. In addition, the dislocation density ρ was more than $3.5\times10^{15}$ ($m^{-2}$). As a result, the steel plate of Test Number 5-16 did not exhibit excellent SSC resistance in the SSC resistance test using $H_2S$ at 0.01 atm.

In the steel plate of Test Number 5-17, the Mn content was too high. As a result, the steel plate of Test Number 5-17 did not exhibit excellent SSC resistance in the SSC resistance test using $H_2S$ at 0.01 atm.

In the steel plate of Test Number 5-18, the Cr content was too low. As a result, the steel plate of Test Number 5-18 did not exhibit excellent SSC resistance in the SSC resistance test using $H_2S$ at 0.01 atm.

In the steel plate of Test Number 5-19, the Mo content was too low. As a result, the steel plate of Test Number 5-19 did not exhibit excellent SSC resistance in the SSC resistance test using $H_2S$ at 0.01 atm.

In the steel plate of Test Number 5-20, the V content was too low. Consequently, the specific precipitates proportion was less than 15%. In addition, the yield strength YS was less than 1069 MPa, and a yield strength of 155 ksi grade was not obtained.

An embodiment of the present invention has been described above. However, the embodiment described above is merely an example for implementing the present invention. Accordingly, the present invention is not limited to the above embodiment, and the above embodiment can be appropriately modified and performed within a range that does not deviate from the gist of the present invention.

INDUSTRIAL APPLICABILITY

The steel material according to the present invention is widely applicable to steel materials to be utilized in a severe environment such as a polar region, and preferably can be utilized as a steel material that is utilized in an oil well environment, and further preferably can be utilized as a steel material for casing, tubing or line pipes or the like.

The invention claimed is:

1. A steel material comprising a chemical composition consisting of, in mass %, C: 0.10 to 0.60%, Si: 0.05 to 1.00%, Mn: 0.05 to 1.00%, P: 0.025% or less, S: 0.0100% or less, Al: 0.005 to 0.100%, Cr: 0.20 to 1.50%, Mo: 0.25 to 1.50%, V: 0.01 to 0.60%, Ti: 0.002 to 0.050%, B: 0.0001 to 0.0050%, N: 0.0020 to 0.0100%, O: 0.0100% or less, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50%, rare earth metal: 0 to 0.0100%, and with the balance being Fe and impurities, wherein in the steel material, among precipitates having an equivalent circular diameter of not more than 80 nm, a numerical proportion of precipitates for which a ratio of a Mo content to a total content of alloying elements excluding carbon is not more than 50% is 15% or more, a yield strength is within a range of 655 to 1172 MPa, a dislocation density ρ is $3.5\times10^{15}$ $m^{-2}$ or less, in a case where the yield strength is within a range of 655 to less than 758 MPa, the dislocation density ρ is less than $2.0\times10^{14}m^{-2}$ and Fn1 that is expressed by Formula (1) is less than 2.90, in a case where the yield strength is within a range of 758 to less than 862 MPa, the dislocation density ρ is $3.0\times10^{14}m^{-2}$ or less and Fn1 that is expressed by Formula (1) is 2.90 or more, in a case where the yield strength is within a range of 862 to less than 965 MPa, the dislocation density ρ is within a range of more than $3.0\times10^{14}$ to $7.0\times10^{14}$ $m^{-2}$, in a case where the yield strength is within a range of 965 to less than 1069 MPa, the dislocation density ρ is within a range of more than $7.0\times10^{14}$ to $15.0\times10^{14}m^{-2}$, and in a case where the yield strength is within a range of 1069 to 1172 MPa, the dislocation density ρ is within a range of more than 1 $5\times10^{15}$ to $3.5\times10^{15}$ $m^{-2}$:

$$Fn1=2\times10^{-7}\times\sqrt{\rho}+0.4/(1.5-1.9\times[C]) \quad (1)$$

where, in Formula (1), the dislocation density, in $m^{-2}$ is substituted for ρ, and the C content, in mass %, in the steel material is substituted for [C].

2. The steel material according to claim 1, wherein the chemical composition contains:

Nb: 0.002 to 0.030%.

3. The steel material according to claim 1, wherein the chemical composition contains one or more elements selected from the group consisting of:

Ca: 0.0001 to 0.0100%,

Mg: 0.0001 to 0.0100%, and

Zr: 0.0001 to 0.0100%.

4. The steel material according to claim 1, wherein the chemical composition contains one or more elements selected from the group consisting of:

Co: 0.02 to 0.50%, and

W: 0.02 to 0.50%.

5. The steel material according to claim 1, wherein the chemical composition contains one or more elements selected from the group consisting of:

Ni: 0.01 to 0.50%, and

Cu: 0.01 to 0.50%.

6. The steel material according to claim 1, wherein the chemical composition contains:

rare earth metal: 0.0001 to 0.0100%.

7. The steel material according to claim 1, wherein:

in a microstructure of the steel material, a block diameter is 1.5 μm or less.

8. The steel material according to claim 1, wherein:

the yield strength is within a range of 655 to less than 758 MPa, the dislocation density p is less than $2.0\times10^{14}m^{-2}$, and Fn1 that is expressed by Formula (1) is less than 2.90:

$$Fn1=2\times10^{-7}\times\sqrt{\rho}+0.4/(1.5-1.9\times[C]) \quad (1).$$

9. The steel material according to claim 1, wherein:

the yield strength is within a range of 758 to less than 862 MPa, the dislocation density p is $3.0\times10^{14}$ $m^{-2}$ or less, and Fn1 that is expressed by Formula (1) is 2.90 or more:

$$Fn1=2\times10^{-7}\times\sqrt{\rho}+0.4/(1.5-1.9\times[C]) \quad (1).$$

10. The steel material according to claim 1, wherein:

the yield strength is within a range of 862 to less than 965 MPa, and the dislocation density p is within a range of more than $3.0\times10^{14}$ to $7.0\times10^{14}m^{-2}$.

11. The steel material according to claim 1, wherein:

the yield strength is within a range of 965 to less than 1069 MPa, and the dislocation density p is within a range of more than $7.0\times10^{14}$ to $15.0\times10^{14}m^{-2}$.

12. The steel material according to claim 1, wherein:

the yield strength is within a range of 1069 to 1172 MPa, and the dislocation density p is within a range of more than 1 $5\times10^{15}$ to $3.5\times10^{15}m^{-2}$.

13. The steel material according to claim 1, wherein:

the steel material is an oil-well steel pipe.

* * * * *